US008838008B2

(12) United States Patent
Nara et al.

(10) Patent No.: US 8,838,008 B2
(45) Date of Patent: Sep. 16, 2014

(54) DEVICE FOR SWITCHING TRANSPORT DIRECTION OF RECORDING MATERIAL, AND IMAGE FORMING APPARATUS

(75) Inventors: Ryosuke Nara, Kanagawa (JP); Masahiro Mori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 165 days.

(21) Appl. No.: 13/469,321

(22) Filed: May 11, 2012

(65) Prior Publication Data

US 2013/0156479 A1 Jun. 20, 2013

(30) Foreign Application Priority Data

Dec. 15, 2011 (JP) ..... 2011-274496

(51) Int. Cl.
*G03G 15/00* (2006.01)

(52) U.S. Cl.
USPC ..... 399/361; 271/184

(58) Field of Classification Search
CPC ..... G03G 15/00
USPC ..... 399/361, 363, 364, 381, 397, 400, 401
See application file for complete search history.

(56) References Cited

U.S. PATENT DOCUMENTS

| | | | | | |
|---|---|---|---|---|---|
| 4,202,621 | A * | 5/1980 | Yoshimura et al. | ..... | 399/407 |
| 8,336,874 | B2 * | 12/2012 | Kato et al. | ..... | 271/117 |

FOREIGN PATENT DOCUMENTS

| | | | | | |
|---|---|---|---|---|---|
| GB | EP 0664494 | A2 * | 7/1995 | ..... | G03G 15/00 |
| JP | 6-140238 | A | 5/1994 | | |
| JP | 7-196180 | A | 8/1995 | | |
| JP | 2003178916 | A * | 6/2003 | ..... | G03G 15/00 |
| JP | 2006-36001 | A | 2/2006 | | |
| JP | 2007-173709 | A | 7/2007 | | |
| JP | 2008-233828 | A | 10/2008 | | |
| JP | 2009-152492 | A | 7/2009 | | |
| JP | 2011-23588 | A | 2/2011 | | |

* cited by examiner

*Primary Examiner* — Nguyen Ha
(74) *Attorney, Agent, or Firm* — Sughrue Mion, PLLC

(57) ABSTRACT

A device for switching a transport direction of a recording material includes a switching unit and a movement unit. The switching unit switches a transport direction of a recording material by being selectively moved to a first position or a second position. The movement unit moves the switching unit between the first position and the second position by increasing or reducing a force exerted on the switching unit. The movement unit changes, on the basis of a temperature of the movement unit, timing at which the force exerted on the switching unit is increased or reduced.

5 Claims, 16 Drawing Sheets

DEVICE FOR SWITCHING TRANSPORT DIRECTION OF RECORDING MATERIAL, AND IMAGE FORMING APPARATUS

CROSS-REFERENCE TO RELATED APPLICATIONS

This application is based on and claims priority under 35 USC 119 from Japanese Patent Application No. 2011-274496 filed Dec. 15, 2011.

BACKGROUND (i) Technical Field

The present invention relates to a device for switching the transport direction of a recording material, and an image forming apparatus.

(ii) Related Art

Hitherto, sheet-transport-path switching devices using a gate system have been employed as devices for switching the transport direction of a sheet in a branch portion of a sheet transport path provided in an image forming apparatus such as a copier or printer using an electrophotographic system. In such a sheet-transport-path switching device using a gate system, a guide whose position is switched using a solenoid or the like is provided in the branch portion, the entrance of a transport path different from a selected transport path is blocked, and a sheet is transported to the selected transport path.

SUMMARY

According to an aspect of the invention, there is provided a device for switching a transport direction of a recording material. The device includes a switching unit and a movement unit. The switching unit switches a transport direction of a recording material by being selectively moved to a first position or a second position. The movement unit moves the switching unit between the first position and the second position by increasing or reducing a force exerted on the switching unit. The movement unit changes, on the basis of a temperature of the movement unit, timing at which the force exerted on the switching unit is increased or reduced.

BRIEF DESCRIPTION OF THE DRAWINGS

Exemplary embodiments of the present invention will be described in detail based on the following figures, wherein.

DETAILED DESCRIPTION

Description of Entire Image Forming Apparatus

Hereinafter, exemplary embodiments of the present invention will be described in detail with reference to the accompanying drawings.

Figure 1:
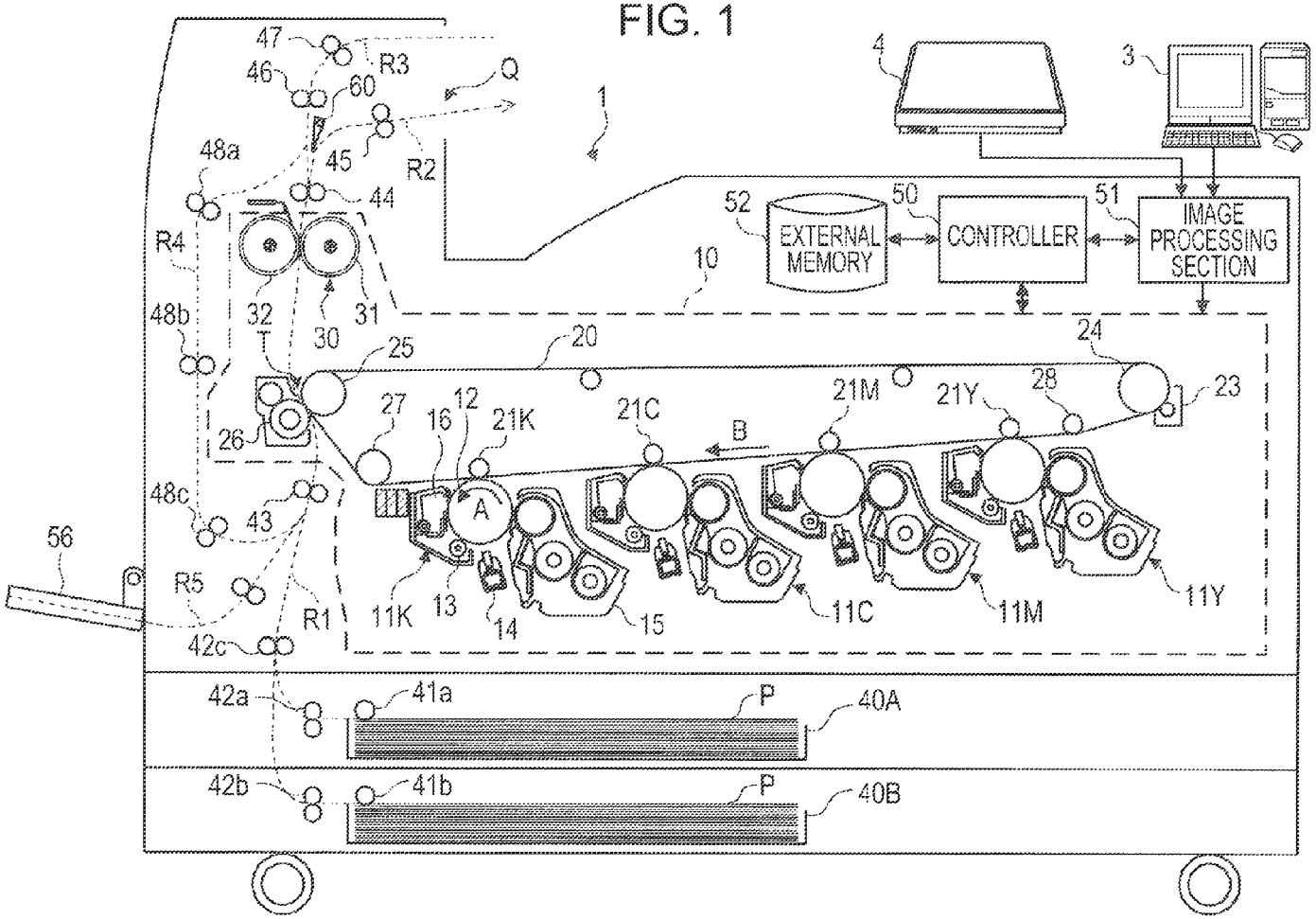
FIG. 1 is a diagram illustrating a configuration of an image forming apparatus according to a present exemplary embodiment.

FIG. 1 is a diagram illustrating a configuration of an image forming apparatus 1 according to a present exemplary embodiment. The image forming apparatus 1 illustrated in FIG. 1 is configured as a so-called tandem image forming apparatus using an electrophotographic system, and includes an image forming process section 10 and a controller 50. The image forming process section 10 is provided as an example of a toner-image forming unit that forms a toner image. The controller 50 controls operations of the entire image forming apparatus 1. Furthermore, the image forming apparatus 1 further includes an image processing section 51 and an external memory 52. The image processing section 51 performs predetermined image processing on image data received from, for example, a personal computer (PC) 3 or an image reading apparatus 4 such as a scanner. Processing programs and so forth are recorded in the external memory 52, and the external memory 52 is realized using, for example, a hard disk drive.

The image forming process section 10 includes four image forming units 11Y, 11M, 11C, and 11K (hereinafter, may be collectively referred to as "image forming units 11") that are disposed in parallel at predetermined spacings and that form toner images of yellow (Y), magenta (M), cyan (C), and black (K), respectively.

Each of the image forming units 11 includes a photoconductor drum 12, a charging roller 13, and a print head 14. An electrostatic latent image is formed on the photoconductor drum 12 while the photoconductor drum 12 is being rotated in the direction indicated by the arrow A. The charging roller 13 uniformly charges the surface of the photoconductor drum 12 using a predetermined electric potential. The print head 14 exposes the photoconductor drum 12, which has been changed by the charging roller 13, to light on the basis of image data. Furthermore, the image forming unit 11 further includes a developing device 15 and a drum cleaner 16. The developing device 15 develops the electrostatic latent image, which has been formed on the photoconductor drum 12. The drum cleaner 16 cleans the surface of the photoconductor drum 12. The four individual image forming units 11Y, 11M, 11C, and 11K have substantially the same configuration except for toners stored in the developing devices 15. Each of the image forming units 11 forms a corresponding one of toner images of yellow (Y), magenta (M), cyan (C), and black (K).

Moreover, the image forming process section 10 further includes an intermediate transfer belt 20, and a first transfer rollers 21Y, 21M, 21C, and 21K (hereinafter, may be collectively referred to as "first transfer rollers 21"). The toner images of the individual colors, which have been formed on the individual photoconductor drum 12 of the image forming units 11, are transferred onto the intermediate transfer belt 20 by multi-transfer. The first transfer rollers 21 sequentially transfer (first transfer) the toner images of the individual colors of the image forming units 11 onto the intermediate transfer belt 20. Additionally, the image forming process section 10 further includes a second transfer roller 26 and a fixing unit 30. The second transfer roller 26 collectively transfers (second transfer) the superimposed toner images, which have been transferred onto the intermediate transfer belt 20, onto a sheet of paper P, which is a recording material (a sheet of recording paper), in a second transfer unit T. The fixing unit 30 fixes, on the sheet of paper P, an image that has been transferred by second transfer. In the image forming apparatus 1 according the present exemplary embodiment, a transfer unit that transfers the toner images onto the sheet of paper P is constituted by the intermediate transfer belt 20, the first transfer rollers 21, and the second transfer roller 26. Furthermore, the fixing unit 30 functions as a fixing unit that fixes the toner images on the sheet of paper P.

The intermediate transfer belt 20 is stretched around a driving roller 24, a backup roller 25, a tension roller 27, stretching rollers 28, the first transfer rollers 21Y, 21M, 21C, and 21K, and so forth. The driving roller 24 rotationally drives the intermediate transfer belt 20. The backup roller 25 is disposed at a position that opposes the position of the second transfer roller 26. The tension roller 27 applies a tension to the intermediate transfer belt 20. The intermediate transfer belt 20 is rotated in the direction indicated by the arrow B.

The fixing unit 30 includes a fixing roller 31 and a pressure roller 32. The fixing roller 31 has a heat source therein. The pressure roller 32 is disposed so as to be pressed against the fixing roller 31. The fixing unit 30 fixes the toner images on the sheet of paper P by causing the sheet of paper P, on which the toner images that have not been fixed are held, to pass between the fixing roller 31 and the pressure roller 32 so as to heat and pressurize the sheet of paper P.

In the image forming apparatus 1 according to the present exemplary embodiment, the image forming process section 10 performs an image forming operation under control performed by the controller 50. In other words, in a case of forming a color image, print job data or the like that is input from the PC 3 or the image reading apparatus 4 is subjected to the predetermined image processing by the image processing section 51, and transmitted to the print head 14 for each of the colors. Then, for example, in the image forming unit 11K for black (K), the surface of the photoconductor drum 12, which has been uniformly charged by the charging roller 13 using the predetermined electric potential, is exposed to light by the print head 14 on the basis of image data for black (K), which has been transmitted from the image processing section 51, whereby an electrostatic latent image is formed on the photoconductor drum 12. The formed electrostatic latent image is developed by the developing device 15, whereby a toner image of black (K) is formed on the photoconductor drum 12. Also in the image forming units 11Y, 11M, and 11C, similarly, toner images of the individual colors, i.e., yellow (Y), magenta (M), and cyan (C), respectively, are formed.

Note that, in a case of forming a monochrome image, a toner image of black (K) is formed only in the image forming unit 11K for black (K).

In the image forming apparatus 1 according to the present exemplary embodiment, transport paths R1, R2, R3, R4, and R5 are provided as paper transport systems.

The transport path R1 is a path for transporting a sheet of paper P from a paper storage tray 40A or 40B to the second transfer unit T and the fixing unit 30.

The transport path R2 is a path for ejecting, from a sheet ejection unit Q, the sheet of paper P that has been transported along the transport path R1.

The transport path R3 is a path for, in order to reverse the sheet of paper P that has been transported along the transport path R1, switching back the sheet of paper P.

The transport path R4 is a path used for duplex-printing, and is a path for transporting, to the transport path R1 again, the sheet of paper P that has been reversed along the transport path R3. In other words, when the sheet of paper P is transported from the transport path R4 to the transport path R1, the sheet of paper P passes through the second transfer unit T and the fixing unit 30, whereby formation of an image on the rear side, which is a second side, of the sheet of paper P is performed.

The transport path R5 is a path for transporting, to the second transfer unit T, a sheet of paper P that has been transported from a paper storage tray 56 for manual paper feeding.

Furthermore, in the image forming apparatus 1 according to the present exemplary embodiment, a switching unit 60 that, for a sheet of paper P which has been transported along the transport path R1, switches the transport path of the sheet of paper P to one of the other transport paths R2, R3, and R4 is provided, although the details of the switching unit 60 are described below.

The toner images of the individual colors, which have been formed in the image forming units 11, are sequentially electrostatically transferred by the individual first transfer rollers 21, to which a predetermined first transfer bias voltage is applied from a power supply device serving as a high-voltage power supply for first transfer, onto the intermediate transfer belt 20, which is rotated in the direction indicated by the arrow B. Accordingly, superimposed toner images are formed on the intermediate transfer belt 20. The superimposed toner images are transported to the second transfer unit T, in which the second transfer roller 26 and the backup roller 25 are disposed, in accordance with movement of the intermediate transfer belt 20.

In contrast, in the image forming apparatus 1, multiple sheets of paper P have different sizes or are different types of sheets of paper, and are stored for each of the sizes or types in the paper storage tray 40A or 40B. When the sheets of paper P stored in the paper storage tray 40A are specified by the controller 50, each of the sheets of paper P is fed out from the paper storage tray 40A by a feed roller 41*a*, and is transported on a sheet-by-sheet basis by transport rollers 42*a* and 42*c* to the position of registration rollers 43 along the transport path R1. Furthermore, when the sheets of paper P stored in the paper storage tray 40B are specified by the controller 50, each of the sheets of paper P is fed out from the paper storage tray 40B by a feed roller 41*b*, and is transported on a sheet-by-sheet basis by the transport rollers 42*a*, 42*b* and 42*c* to the position of the registration rollers 43 along the transport path R1. Note that, in the present exemplary embodiment, although the paper storage trays 40A and 40B are provided, a configuration may be used, in which paper storage trays, the number of paper storage trays being more than two, are provided.

Next, the sheet of paper P is fed out from the registration rollers 43 at a time that matches a time at which the toner images of the individual colors formed on the intermediate transfer belt 20 are transported to the second transfer unit T. A voltage is applied to the second transfer unit T from a power supply device serving as a high-voltage power supply for second transfer. Accordingly, the toner images of the individual colors are collectively electrostatically transferred (second transfer) onto the sheet of paper P using the effect of a transfer electric field formed by the second transfer roller 26 and the backup roller 25.

After that, the sheet of paper P, onto which the superimposed toner images have been electrostatically transferred, is separated from the intermediate transfer belt 20, and transported to the fixing unit 30. The toner images, which are on the sheet of paper P transported to the fixing unit 30 and which have not been fixed, are subjected by the fixing unit 30 to a fixing process of heating and pressurizing the sheet of paper P, whereby the toner images are fixed on the sheet of paper P. Then, the sheet of paper P on which an image is formed is transported by the switching unit 60 from the transport path R1 to the transport path R2 in a case of simplex printing, whereby the sheet of paper P is ejected from the sheet ejection unit Q of the image forming apparatus 1 by transport rollers 44 and ejection rollers 45.

Note that toner (residual toner after transfer) adhered to the intermediate transfer belt 20 after second transfer is performed is removed by a belt cleaner 23 that is disposed so as to be in contact with the intermediate transfer belt 20, thereby making preparation for the next image formation cycle.

In contrast, in a case of duplex printing, when an image has been formed on the front side, which is a first side, of the sheet of paper P, and the sheet of paper P is transported, the sheet of paper P is transported by the switching unit 60 from the transport path R1 to the transport path R3. The sheet of paper P that is transported along the transport path R3 is stopped once. After that, the sheet of paper P is switched back and returned to the original direction. In this case, regarding the switching unit 60, the position thereof is changed within a time period within which another sheet of paper P is being transported along the transport path R2. Then, the sheet of paper P is transported to the transport path R4 by the function of the switching unit 60.

The sheet of paper P, which has been transported to the transport path R4, is transported by duplex-printing transport rollers 48*a*, 48*b*, and 48*c*, and reaches the second transfer unit T. In the second transfer unit T, as in the case of transferring toner images onto the front side, toner images of the individual colors that are held on the intermediate transfer belt 20 are collectively transferred (second transfer) onto the rear side, which is the second side, of the sheet of paper P using the transfer electric field formed by the second transfer roller 26 and the backup roller 25.

The toner images have been transferred on both sides of the sheet of paper P as described above, and, the toner images transferred onto the rear side are fixed by the fixing unit 30 on the sheet of paper P as in the case of fixing toner images on the front side. Then, the sheet of paper P is transported from the transport path R1 to the transport path R2, and ejected from the sheet ejection unit Q of the image forming apparatus 1. Note that, in a case in which the number of sheets of paper P to be subjected to duplex printing is one, image formation is performed as described above. However, in a case of performing duplex printing on multiple sheets of paper P, image formation is performed following the procedure described below.

FIGS. 2A to 2G are diagrams for explaining operations of individual mechanisms in the case of performing duplex printing on multiple sheets of paper P.

Here, a case of feeding out sheets of paper P from the paper storage tray 40A will be described.

Figure 2A:
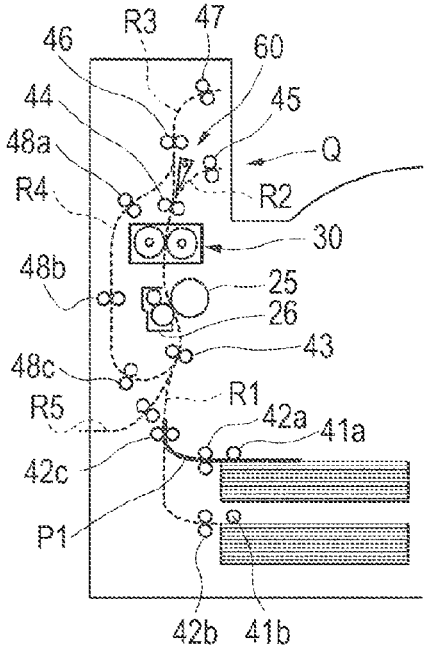
FIGS. 2A to 2G are diagrams for explaining operations of individual mechanisms in a case of performing duplex printing on multiple sheets of paper.

First, a first sheet of paper P1 is fed out from the paper storage tray 40A by using the feed roller 41*a*, and transported to the transport path R1 (FIG. 2A).

Figure 2B:
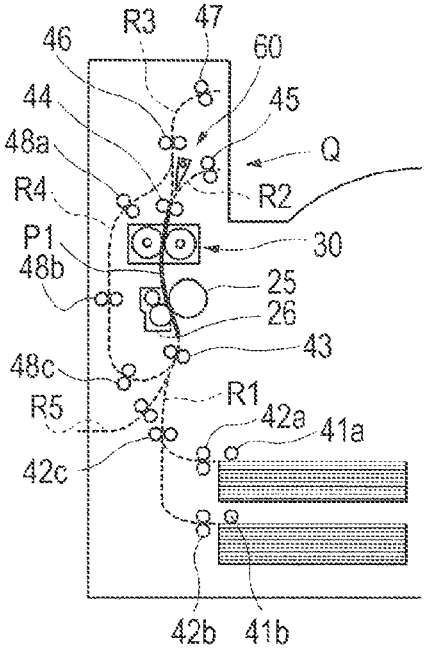

The sheet of paper P1 is fed out by the transport rollers 42*a* and 42*c* and the registration rollers 43 along the transport path R1 in the direction toward the top in FIG. 2A. Then, toner images are transferred (second transfer) by the second transfer unit T onto the sheet of paper P1, and are fixed by the fixing unit 30 on the sheet of paper P1, whereby an image is formed on the front side of the sheet of paper P1 (FIG. 2B).

Figure 2C:
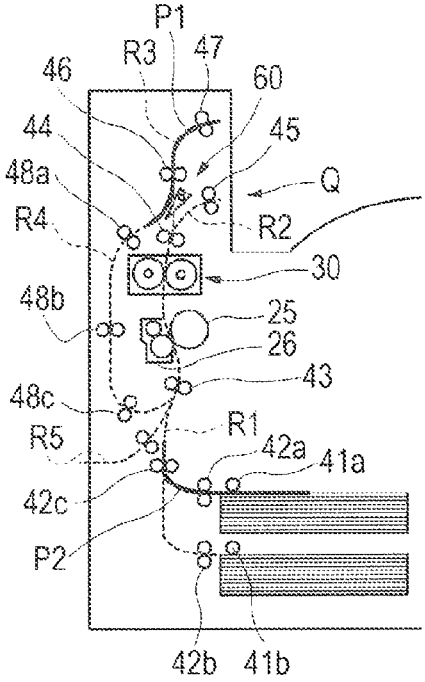

Next, the switching unit 60 is switched, and the sheet of paper P1 is transported to the transport path R3 by the function of the switching unit 60. Then, the sheet of paper P1 is transported by the transport rollers 44, reversing rollers 46, and ejection rollers 47 to a reverse position that is a position at which the sheet of paper P1 is to be switched back. Then, when the sheet of paper P1 reaches the reverse position, the sheet of paper P1 is temporarily stopped by temporarily stopping the reversing rollers 46 and the ejection rollers 47. Next, when the switching unit 60 is switched again in order to transport the sheet of paper P1 to the transport path R4, the reversing rollers 46 and the ejection rollers 47 are rotated in the direction opposite to the direction in which the reversing rollers 46 and the ejection rollers 47 were immediately previously rotated. Consequently, the sheet of paper P1 is fed out to the direction of the transport path R4 by the reversing rollers 46 and the ejection rollers 47 (FIG. 2C). In this manner, a reverse operation of reversing the sheet of paper P1 is performed. Note that, at this point in time, a second sheet of paper P2 is transported to the transport path R1.

Figure 2D:
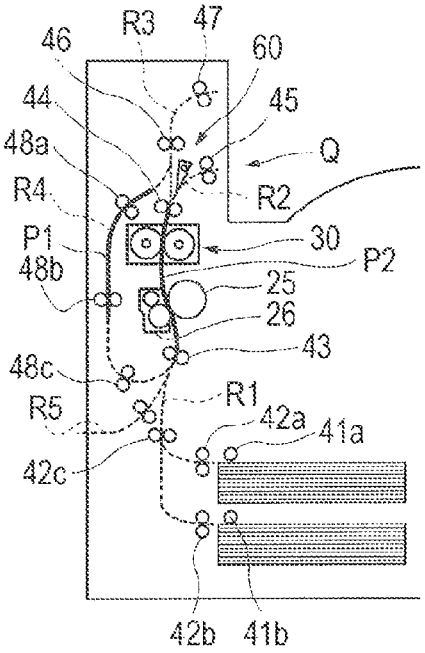

While the sheet of paper P1 is being moved along the transport path R4 in the direction toward the bottom in FIG. 2C by being transported by the duplex-printing transport rollers 48*a*, 48*b*, and 48*c*, an image is formed on the front side of the sheet of paper P2 as in the case of the sheet of paper P1. Note that, at this point in time, the reversing rollers 46 and the ejection rollers 47 are temporarily stopped, and the switching unit 60 is switched again in order to transport the sheet of paper P2 from the transport path R1 to the transport path R3 (FIG. 2D).

Figure 2E:
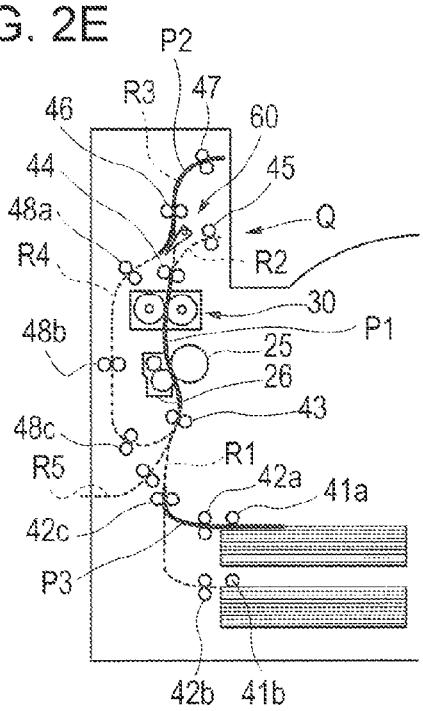

The sheet of paper P2 is transported from the transport path R1 to the transport path R3 by the function of the switching unit 60. As in the case of the sheet of paper P1, the reverse operation is performed. The sheet of paper P2 that has been subjected to the reverse operation is transported by the switching unit 60 to the transport path R4. Furthermore, the sheet of paper P1 again enters the transport path R1 from the transport path R4, and an image is formed on the rear side of the sheet of paper P1. Then, the sheet of paper P1 is transported by the switching unit 60 from the transport path R1 to the transport path R2 at a time that is the same as a time at which the sheet of paper P2 is transported from the transport path R3 to the transport path R4. The sheet of paper P1 is ejected from the sheet ejection unit Q by the ejection rollers 45. Furthermore, at this point in time, a third sheet of paper P3 is transported to the transport path R1 (FIG. 2E).

While the sheet of paper P2 is being moved along the transport path R4 by being transported by the duplex-printing transport rollers 48*a*, 48*b*, and 48*c*, an image is formed on the front side of the sheet of paper P3. Moreover, at this point in time, the switching unit 60 is switched again in order to transport the sheet of paper P3 from the transport path R1 to the transport path R3 (FIG. 2F).

The sheet of paper P3 is transported from the transport path R1 to the transport path R3 by the function of the switching unit 60, and the reverse operation is performed on the sheet of paper P3. The sheet of paper P3, which has been subjected to the reverse operation, is transported to the transport path R4 by the switching unit 60. Additionally, the sheet of paper P2 again enters the transport path R1 from the transport path R4, and an image is formed on the rear side of the sheet of paper P2. Then, simultaneously with transport of the sheet of paper P3 from the transport path R3 to the transport path R4, the sheet of paper P2 is transported from the transport path R1 to the transport path R2 by the switching unit 60, and ejected from the sheet ejection unit Q by the ejection rollers 45. Moreover, at this point in time, a fourth sheet of paper P4 is transported to the transport path R1 (FIG. 2G).

Figure 2F:
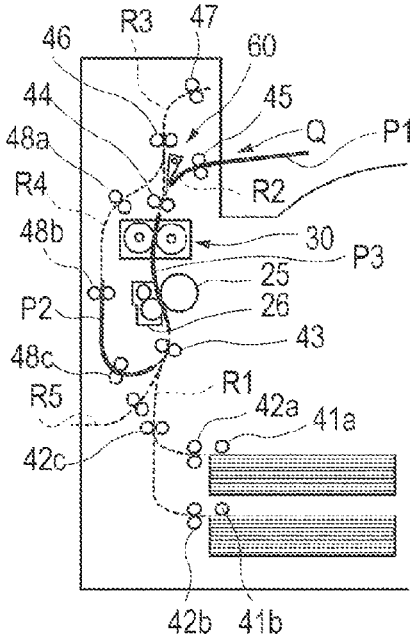
Figure 2G:
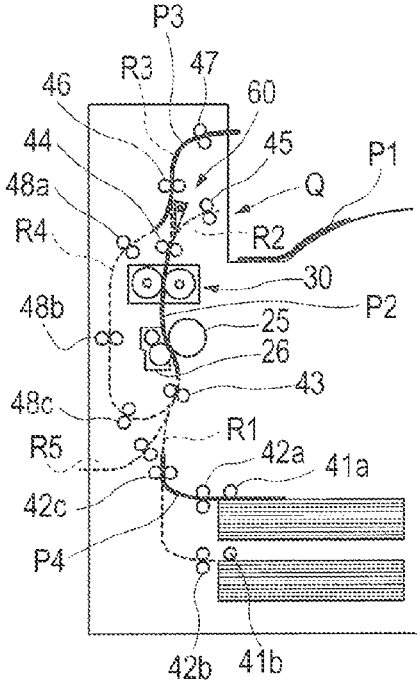

Thereafter, the operations illustrated in FIGS. 2F and 2G are repeated.

As described above, image formation is repeatedly performed in the image forming apparatus 1 a number of times corresponding to a specified number of sheets. Note that, in the present exemplary embodiment, the feed rollers 41*a* and 41*b*, the transport rollers 42*a*, 42*b*, and 42*c*, the registration rollers 43, the transport rollers 44, the ejection rollers 45, the reversing rollers 46, the ejection rollers 47, or the duplex-printing transport rollers 48*a*, 48*b*, and 48*c* may be considered as an example of a recording-material transport unit.

Description of Switching Unit

Figure 3A:
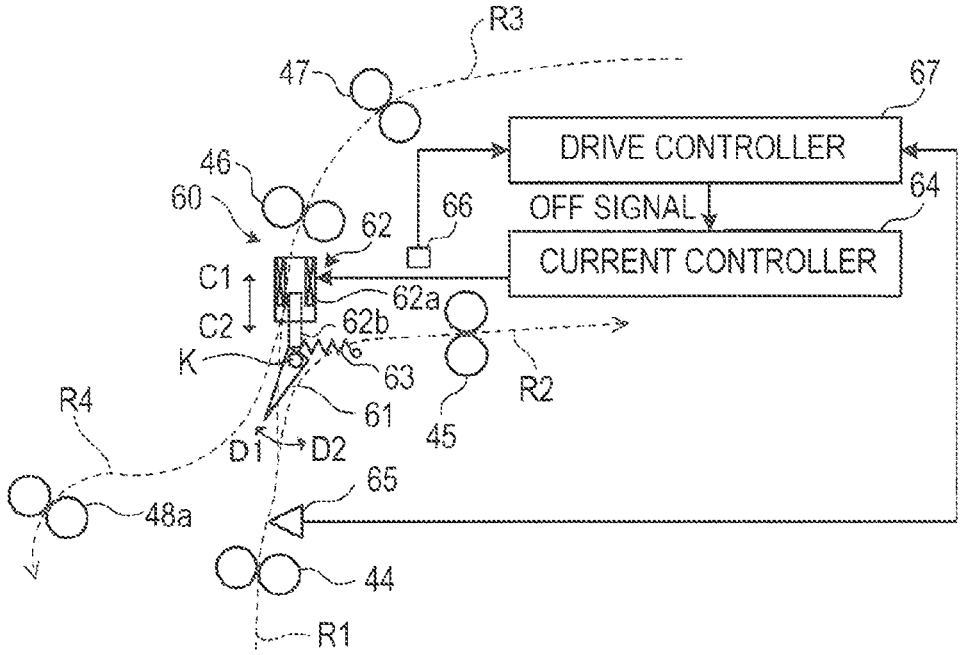
FIGS. 3A and 3B are diagrams for explaining a switching unit (a device that switches the transport direction of a recording material)
Figure 3B:
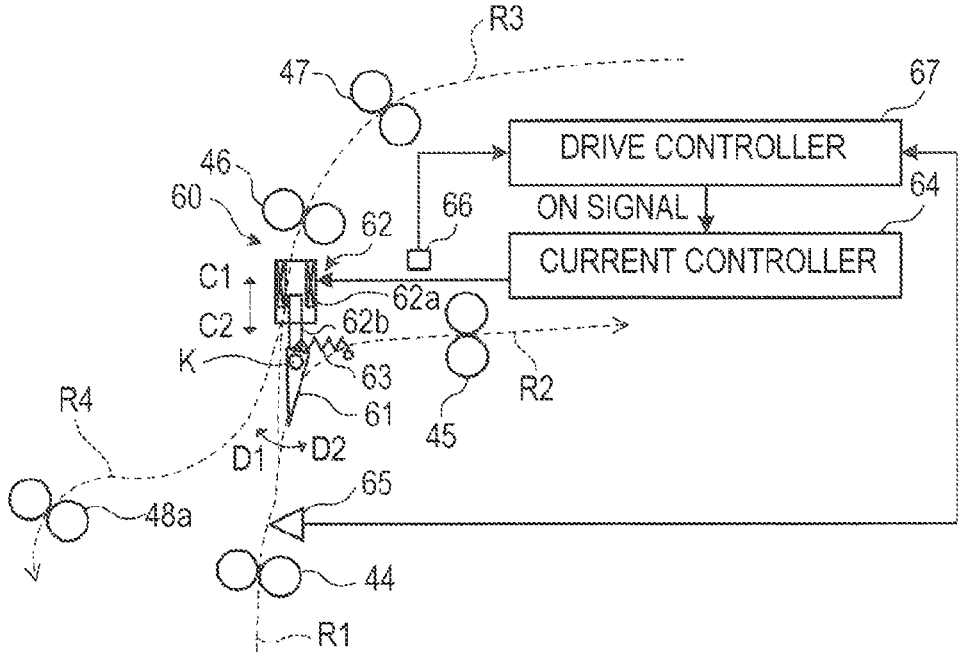
Figure 4:
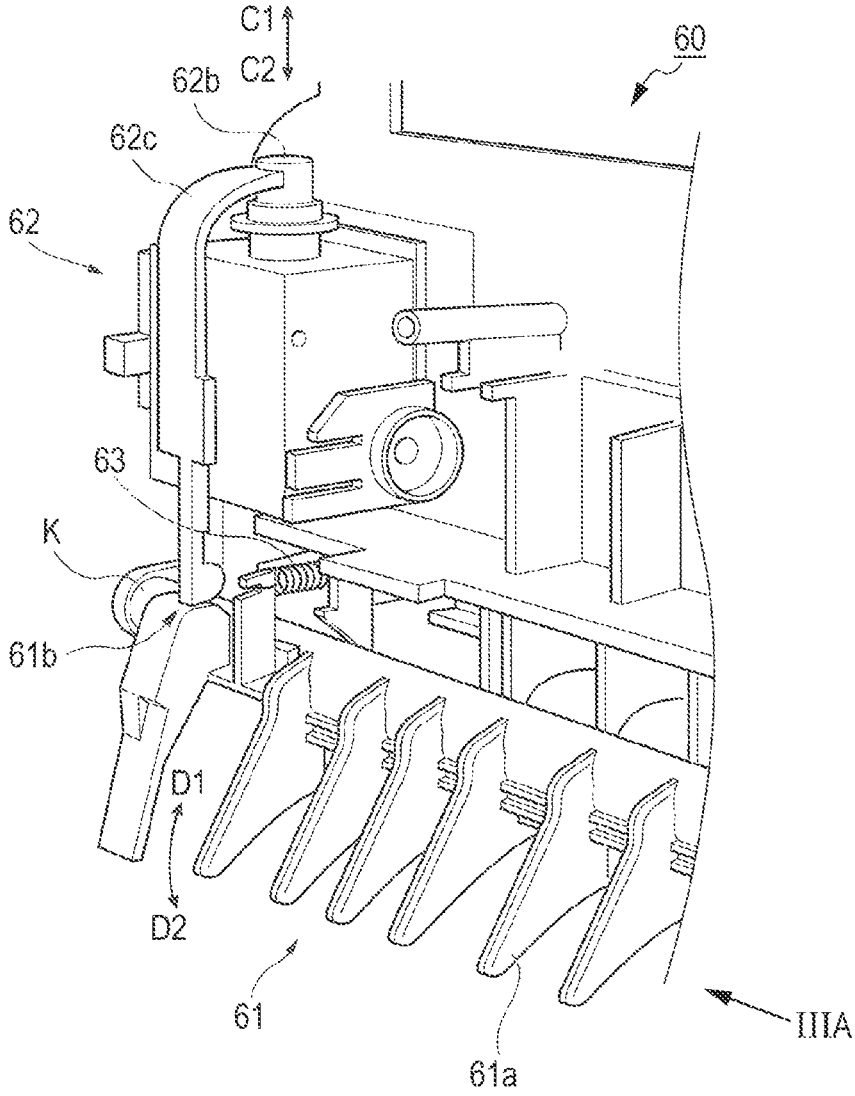
FIG. 4 is a perspective view of the switching unit.

FIGS. 3A and 3B are diagrams for explaining the switching unit (a device that switches the transport direction of a recording material) 60. Furthermore, FIG. 4 is a perspective view of the switching unit 60.

Hereinafter, the configuration and function of the switching unit 60 will be described with reference to FIGS. 3A, 3B and 4. Note that FIGS. 3A and 3B are diagrams in the case in which the switching unit 60 is viewed from the direction IIIA of FIG. 4.

As illustrated in FIGS. 3A and 3B, the switching unit 60 includes a gate member 61, a solenoid 62, a spring member 63, and a current controller 64. The gate member 61 is disposed so as to be rotatable around a rotating shaft K, and is provided as an example of a switching unit that switches the transport direction of a sheet of paper P by being selectively moved to a first position or a second position in a mechanism unit of the image forming apparatus 1 that forms an image on a sheet of paper P. The solenoid 62 is provided as an example of a movement unit that, by increasing or reducing a force exerted on the gate member 61 at a predetermined time, rotates the gate member 61 around the rotating shaft K so as to change the position of the gate member 61, i.e., that moves the gate member 61 between the first position and the second position. The spring member 63 is provided as an example of an elastic body that is connected to the gate member 61 and, for example, a housing of the image forming apparatus, and that moves the gate member 61 between the first position and the second position by collaborating with the solenoid 62. The current controller 64 supplies a current (a drive current) to the solenoid 62.

Moreover, the switching unit 60 further includes a paper detection sensor 65, a temperature sensor 66, and a drive controller 67. The switching unit 60 is disposed downstream of the fixing unit 30 along the transport path R1. The temperature sensor 66 measures an environmental temperature of the switching unit 60. A detection result of the paper detection sensor 65 or the temperature sensor 66 is input to the drive controller 67, and the drive controller 67 controls driving of the solenoid 62. Note that, in the present exemplary embodiment, the current controller 64 or the drive controller 67 may be considered as a controller that controls the switching unit 60. Furthermore, although the current controller 64 or the drive controller 67 may be disposed in the switching unit 60, a configuration may be used, in which the current controller 64 or the drive controller 67 is included in a portion of the controller 50 illustrated in FIG. 1.

As illustrated in FIG. 4, the gate member 61 has a configuration in which multiple members 61*a* having a substantially triangular and plate shape are arranged in a row in a comb shape along the rotating shaft K. The gate member 61 guides a sheet of paper P by being in contact with the sheet of paper P on one side of the triangular shape of the members 61*a*, so that the transport direction of the sheet of paper P is defined.

The solenoid 62 includes a coil 62*a* that has a space therein, and a plunger (movable iron core) 62*b* that is disposed in the space of the coil 62*a*.

The solenoid 62 in the present exemplary embodiment is a so-called push solenoid. Accordingly, when a predetermined current is supplied from the current controller 64 to the coil 62*a*, the plunger 62*b* is attracted by a generated magnetic field. Then, with this attraction, as illustrated in FIG. 3B, the plunger 62*b* is made to project from the inside of the solenoid 62 to the outside, and to move in a direction (the direction indicated by the arrow C2) in which the amount of projection from the body of the solenoid 62 increases. In FIGS. 3A and 3B, for simplicity of description, a simplified illustration is provided. However, in reality, as illustrated in FIG. 4, the pressing member 62*c* connected to the plunger 62*b* is in contact with a predetermined portion 61*b* of the gate member 61. Accordingly, when the pressing member 62*c* projects, by a pressing force that is generated by the projection of the plunger 62*b*, the gate member 61 is rotated around the rotating shaft K (rotated in the direction indicated by the arrow D2), and is moved to a position illustrated in FIG. 3B (the second position).

In contrast, when no current flows through the coil 62*a*, there is no force generated by a magnetic field in the plunger 62*b*. In this case, the gate member 61 is rotated around the rotating shaft K (rotated in the direction indicated by the arrow D1) by a tensile force of the spring member 63, and is moved to a position illustrated in FIG. 3A (the first position). In addition, because of the tensile force of the spring member 63 that is indirectly exerted on the plunger 62*b* via the gate member 61, a force in a direction in which the plunger 62*b* is drawn into the body of the solenoid 62 is exerted on the plunger 62*b*. Accordingly, as illustrated in FIG. 3A, the plunger 62*b* is drawn into the body of the solenoid 62, and is moved in a direction (the direction indicated by the arrow C1) in which the amount of projection from the body of the solenoid 62 decreases.

In other words, depending on whether the predetermined current is not supplied or supplied to the coil 62*a* of the solenoid 62, the gate member 61 is moved between the position illustrated in FIG. 3A (the first position) and the position illustrated in FIG. 3B (the second position), respectively. Similarly, depending on whether the predetermined current is not supplied or supplied to the coil 62*a*, the plunger 62*b* is moved between a position at which the plunger 62*b* is drawn into the body of the solenoid 62 and a position at which the plunger 62*b* is made to project from the body of the solenoid 62, respectively.

In addition, when the current is supplied to the coil 62*a*, a force is applied to the plunger 62*b* so that the plunger 62*b* is moved in the direction (the direction indicated by the arrow C2) in which the amount of projection from the body of the solenoid 62 increases. When supply of the current to the coil 62*a* is stopped, a force in the direction opposite to the direction of the force that was immediately previously applied to the plunger 62*b* is applied to the plunger 62*b* by the tensile force of the spring member 63, i.e., a force is applied to the plunger 62*b* so that the plunger 62*b* is moved in the direction (the direction indicated by the arrow C1) in which the amount of projection from the body of the solenoid 62 decreases.

The drive controller 67 transmits, for example, using information input from the paper detection sensor 65, an ON signal or an OFF signal for the solenoid 62 to the current controller 64. Then, the current controller 64 supplies the current to the coil 62*a* or interrupts supply of the current to the coil 62*a* in accordance with the ON signal or the OFF signal, respectively. In other words, the current controller 64 continues supplying the current to the coil 62*a* while receiving the ON signal from the drive controller 67. Furthermore, the current controller 64 does not supply the current to the coil 62*a* while receiving the OFF signal from the drive controller 67.

In the switching unit 60 configured as illustrated in FIGS. 3A, 3B and 4, when the drive controller 67 outputs the OFF signal, the current controller 64 no longer supplies the current to the solenoid 62. Accordingly, the gate member 61 is moved to the position illustrated in FIG. 3A (the first position). Furthermore, when the drive controller 67 outputs the ON signal, the current controller 64 supplies the predetermined current to the solenoid 62. Accordingly, the gate member 61 is moved to the position illustrated in FIG. 3B (the second position). The gate member 61 and the solenoid 62 are selectively switched by control performed by the drive controller 67, as illustrated in FIG. 3A or FIG. 3B.

At the position illustrated in FIG. 3A, the gate member 61 transports a sheet of paper P from the transport path R1 to the transport path R2. Furthermore, the gate member 61 at the position can transport, to the transport path R4, a sheet of paper P that is reversed after the sheet of paper P has been transported along the transport path R3.

In contrast, in the case illustrated in FIG. 3B, the gate member 61 transports a sheet of paper P from the transport path R1 to the transport path R3.

More specifically, the gate member 61 is normally at the first position illustrated in FIG. 3A. The gate member 61 at the first position is positioned so as to block the transport path R3. Accordingly, a sheet of paper P is transported from the transport path R1 to the transport path R2. Additionally, the gate member 61 at the first position is positioned so as to block the transport path R1 when viewed from the transport path R3. Accordingly, a sheet of paper P is transported from the transport path R3 to the transport path R4. Thus, the first position of the gate member 61 may also be considered as an initial position.

Moreover, when the position of the gate member 61 is changed by supplying the current to the solenoid 62 and, consequently, the gate member 61 is moved to the second position illustrated in FIG. 3B, the gate member 61 at the second position is positioned so as to block the transport path R2. Accordingly, a sheet of paper P can be transported from the transport path R1 to the transport path R3. Thus, the second position of the gate member 61 may also be considered as a drive position.

Description of Control of Operation of Switching Unit

FIGS. 5A to 5D are diagrams for explaining a control method for operating the switching unit 60.

Figure 5A:
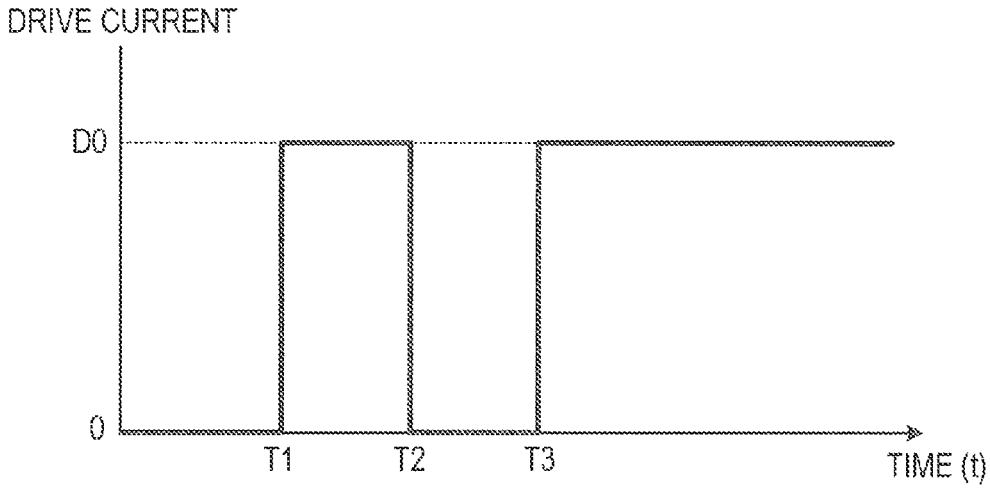
FIGS. 5A to 5D are diagrams for explaining a control method for operating the switching unit.
Figure 5B:
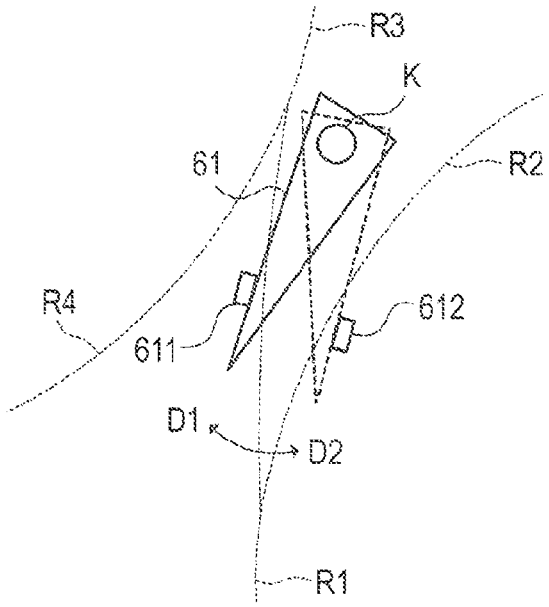

Among FIGS. 5A to 5D, FIG. 5A is a graph for explaining a control signal (a drive signal) that is output from the current controller 64 in a case of moving the gate member 61 from the first position to the second position. Here, the vertical axis represents the amount of drive current, and the horizontal axis represents time (t). Furthermore, FIG. 5B is a diagram illustrating movement of the gate member 61 in this case.

When the drive controller 67 determines that the position of the gate member 61 needs to be switched, the drive controller 67 outputs the ON signal to the current controller 64 as illustrated in FIG. 5A. In this case, the drive controller 67 performs control so as to output the ON signal at a time T1, to output the OFF signal at a time T2, and to output the ON signal at a time T3 again. In accordance with the ON signal or the OFF signal, the current controller 64 outputs a drive signal having an amount D0 of drive current for a time period from the time T1 to the time T2 and at the time T3 and thereafter as illustrated in FIG. 5A.

With this control, as illustrated in FIG. 5B, when the drive controller 67 starts outputting the ON signal at the time T1, and, consequently, the current controller 64 supplies the drive signal having the amount D0 of drive current to the solenoid 62, a force for rotating the gate member 61 in the direction indicated by the arrow D2 is applied to the gate member 61 by the operation of attracting the solenoid 62, and the gate member 61 starts rotating in the direction indicated by the arrow D2. Then, the drive controller 67 continues outputting the ON signal until the time T2.

Then, after the time T2, the drive controller 67 continues outputting the OFF signal until the time T3. Consequently, the current controller 64 stops supply of the current to the solenoid 62. During the time period from the time T2 to the time T3, a force is applied by the effect of the spring member 63 to the gate member 61 that is being rotated in the direction indicated by the arrow D2, which is the present direction, and the direction of the force is opposite to the present direction. In other words, a braking force exerted in the direction indicated by the arrow D1 is applied to the gate member 61, and the gate member 61 is rotated in the direction indicated by the arrow D2 while the rotational speed of the gate member 61 is decreasing. Accordingly, the gate member 61 enters a state of being immediately prior to hitting a stopper 612.

After the time T3, the drive controller 67 continues outputting the ON signal again. In accordance with the ON signal, the current controller 64 continues supplying the drive signal having the amount D0 of drive current. Accordingly, the gate member 61 that is being rotated in the direction indicated by the arrow D2 hits the stopper 612, and, consequently, stops at the second position. Then, after the gate member 61 stops, the force in the direction indicated by the arrow D2 continues being applied to the gate member 61 by the operation of attracting the solenoid 62. Accordingly, the gate member 61 is held at the second position without rotating in the direction indicated by the arrow D1.

Figure 5C:
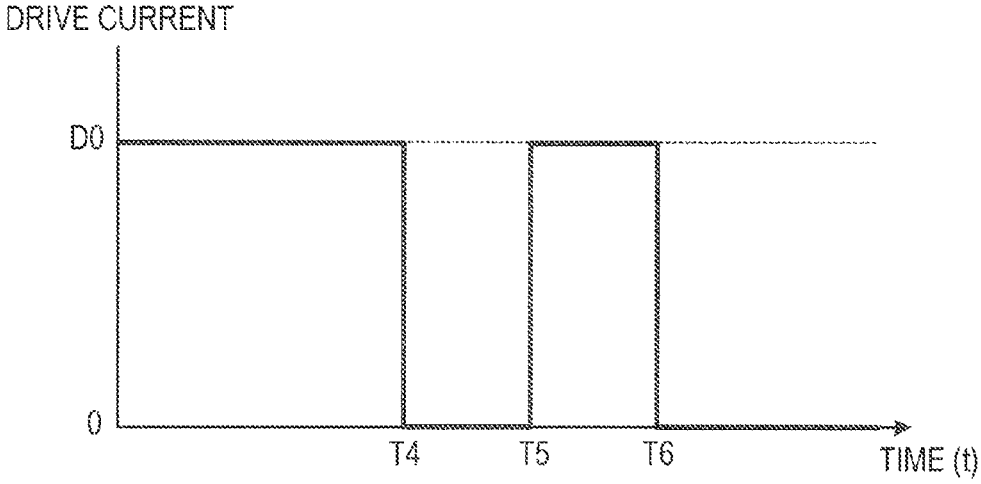

FIG. 5C is a graph for explaining the control signal that is output from the current controller 64 in a case of moving the gate member 61 from the second position to the first position. Here, the vertical axis represents the amount of drive current, and the horizontal axis represents time (t). Furthermore, FIG. 5D is a diagram illustrating movement of the gate member 61 in this case.

When the drive controller 67 determines that the position of the gate member 61 needs to be switched, the drive controller 67 outputs the OFF signal to the current controller 64 as illustrated in FIG. 5C. In this case, the drive controller 67 performs control so as to output the OFF signal at a time T4, to output the ON signal at a time T5, and to output the OFF signal at a time T6 again. In accordance with the ON signal or the OFF signal, the current controller 64 outputs the drive signal having the amount D0 of drive current at the time T4 and prior thereto and for a time period from the time T5 to the time T6 as illustrated in FIG. 5C.

Figure 5D:
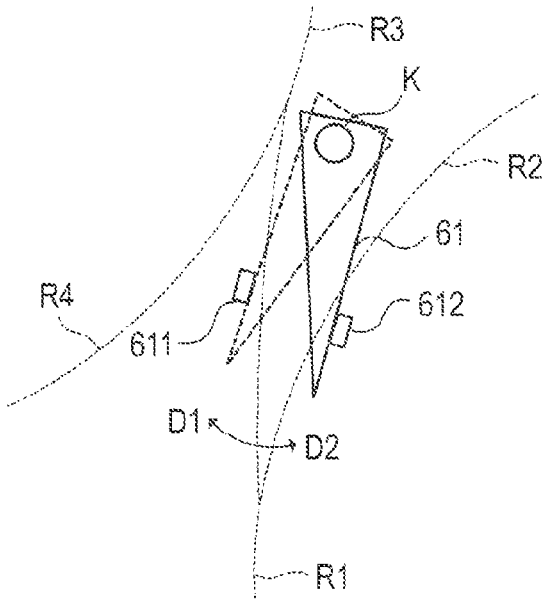

With this control, as illustrated in FIG. 5D, when the drive controller 67 starts outputting the OFF signal at the time T4, and, consequently, the current controller 64 stops supply of the drive current to the solenoid 62, a force for rotating the gate member 61 in the direction indicated by the arrow D1 is applied to the gate member 61 by the tensile force of the spring member 63, and the gate member 61 starts rotating in the direction indicated by the arrow D1. Then, the drive controller 67 continues outputting the OFF signal until the time T5.

Then, after the time T5, the drive controller 67 continues outputting the ON signal until the time T6. The current controller 64 supplies the current to the solenoid 62. During the time period from the time T5 to the time T6, a force is applied by the operation of attracting the solenoid 62 to the gate member 61 that is being rotated in the direction indicated by the arrow D1, which is the present direction, and the direction of the force is opposite to the present direction. In other words, a braking force exerted in the direction indicated by the arrow D2 is applied to the gate member 61, and the gate member 61 is rotated in the direction indicated by the arrow D1 while the rotational speed of the gate member 61 is decreasing. Accordingly, the gate member 61 enters a state of being immediately prior to hitting a stopper 611.

After the time T6, the drive controller 67 continues outputting the OFF signal again. In accordance with the OFF signal, the current controller 64 stops supply of the drive current. Accordingly, the gate member 61 that is being rotated in the direction indicated by the arrow D1 hits the stopper 611, and, consequently, stops at the first position. Then, after the gate member 61 stops, the force in the direction indicated by the arrow D1 continues being applied to the gate member 61 by the tensile force of the spring member 63. Accordingly, the gate member 61 is held at the first position without rotating in the direction indicated by the arrow D2.

As described above, in the case of moving the gate member 61 from the first position to the second position and the case of moving the gate member 61 from the second position to the first position, while the gate member 61 is being moved, a braking force for reducing the rotational speed of the gate member 61 is applied to the gate member 61. Accordingly, the volume of a sound of the gate member 61 hitting the stopper 611 or 612 in the case of switching the position of the gate member 61 is reduced. In a case in which the braking force for reducing the rotational speed of the gate member 61 is not exerted on the gate member 61, when the gate member 61 hits the stopper 611 or 622, the moving speed of the gate member 61 becomes the highest speed. Accordingly, a loud hitting sound occurs. Note that, in the present exemplary embodiment, the stoppers 611 and 612 function as an example of a defining unit that defines the first position and the second position by being in contact with the gate member 61.

However, the force of attraction that is generated in the solenoid 62 may vary in accordance with the temperature of the solenoid 62. In this case, a switching time period taken for the gate member 61 to move between the first position and the second position changes.

Figure 6:
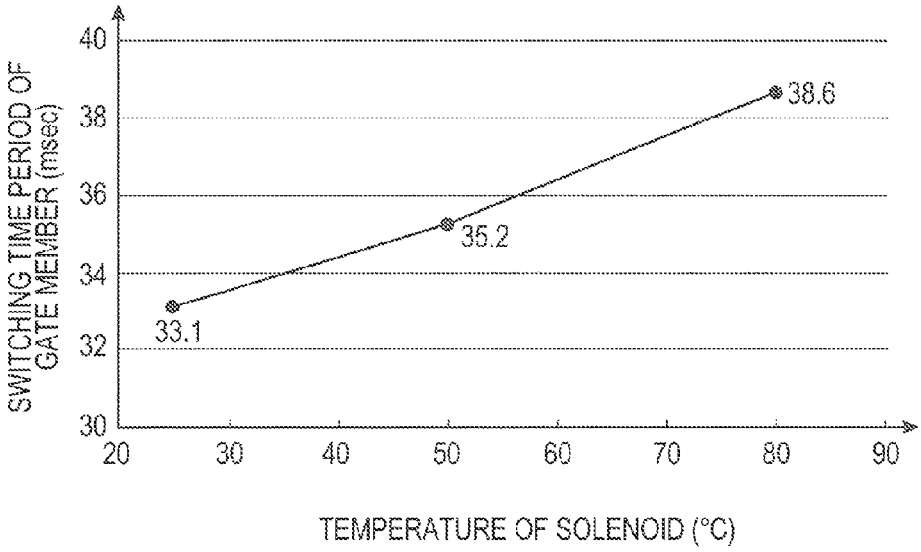
FIG. 6 is a diagram illustrating the relationship between the temperature of a solenoid and a switching time period in a case of moving a gate member from a first position to a second position.

FIG. 6 is a diagram illustrating the relationship between the temperature of the solenoid 62 and the switching time period in the case of moving the gate member 61 from the first position to the second position. Here, the horizontal axis represents the temperature (° C.) of the solenoid 62, and the vertical axis represents the switching time period (ms) of the gate member 61.

As illustrated in FIG. 6, the switching time period of the gate member 61 increases with increasing temperature of the solenoid 62. It is considered that one reason for this is that, when the temperature of the solenoid 62 increases, the internal resistance of the solenoid 62 increases, and, for this reason, the force of attraction generated in the solenoid 62 decreases.

This indicates that, when the temperature of the solenoid 62 increases, the time at which the gate member 61 hits the stopper 612 becomes later in the case of moving the gate member 61 from the first position to the second position. In this case, when the control described above with reference to FIG. 5A is performed, the settings of the times T1 to T3 become inappropriate. Because of this, the volume of the sound of the gate member 61 hitting the stopper 612 in the case of switching the position of the gate member 61 may not be reduced.

In contrast, in the case of moving the gate member 61 from the second position to the first position, conversely, the time at which the gate member 61 hits the stopper 611 becomes earlier. In other words, when the force of attraction generated in the solenoid 62 decreases because the temperature of the solenoid 62 increases, the braking force exerted on the gate member 61 in the direction indicated by the arrow D2 decreases. For this reason, the rotational speed of the gate member 61 is not able to be reduced by a large amount, and the time at which the gate member 61 hits the stopper 611 becomes much earlier. In this case, when the control described above with reference to FIGS. 5A and 5C is performed, the settings of the times T4 to T6 become inappropriate. Because of this, the volume of the sound of the gate member 61 hitting the stopper 611 in the case of switching the position of the gate member 61 may not be reduced.

Therefore, in the present exemplary embodiment, the values of the above-described times T1 to T6 are changed in accordance with the temperature of the solenoid 62. In other words, the time period at which the force exerted on the gate member 61 is increased or reduced are changed on the basis of the temperature of the solenoid 62.

Figure 7:
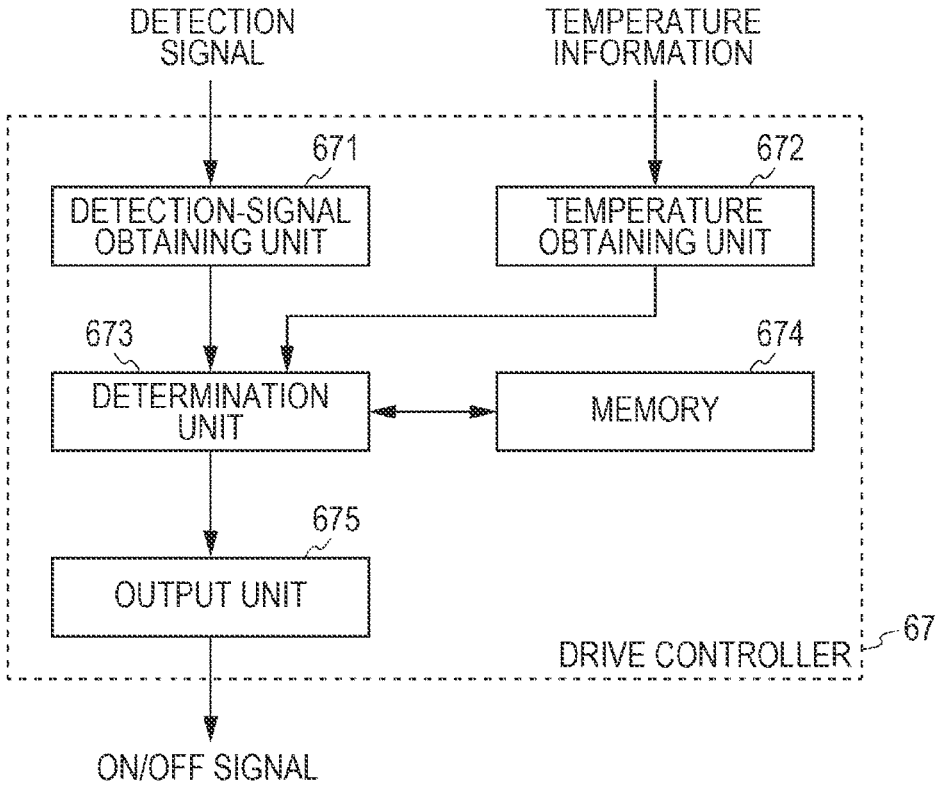
FIG. 7 is a block diagram of a drive controller in the present exemplary embodiment.

FIG. 7 is a block diagram of the drive controller 67 in the present exemplary embodiment.

As illustrated in FIG. 7, the drive controller 67 includes a detection-signal obtaining unit 671, a temperature obtaining unit 672, a determination unit 673, a memory 674, and an output unit 675. The detection-signal obtaining unit 671 receives a detection signal of the paper detection sensor 65. The temperature obtaining unit 672 obtains temperature information from the temperature sensor 66 that measures the environmental temperature of the switching unit 60. The determination unit 673 determines, on the basis of the detection signal obtained by the detection-signal obtaining unit 671 and the temperature information obtained by the temperature obtaining unit 672, times at which the ON signal or the OFF signal is output. In the memory 674, data and so forth are stored, and determination is performed by the determination unit 673 on the basis of the data and so forth stored in the memory 674. The output unit 675 transmits the ON signal or the OFF signal (a pulse signal indicating ON/OFF) to the current controller 64 in accordance with a determination result of the determination unit 673.

The determination unit 673 is a unit that reads data or software which are stored in advance in the memory 674, and that performs a predetermined process. It may be considered that the determination unit 673 is constituted by, for example, a central processing unit (CPU). Furthermore, it may be considered that the memory 674 is constituted by, for example, a memory.

In the drive controller 67, the detection-signal obtaining unit 671 obtains the detection result of the paper detection sensor 65, and, further, the temperature obtaining unit 672 obtains the environmental temperature from the temperature sensor 66. Then, the output unit 675 outputs the ON signal or the OFF signal at the times that have been determined by the determination unit 673 on the basis of the obtained detection result and the obtained environmental temperature.

Note that, in the example given above, the temperature sensor 66 measures the environmental temperature of the switching unit 60 instead of directly measuring the temperature of the solenoid 62. The reason for this is that, even in this manner, the temperature of the solenoid 62 can be estimated and determined. As a matter of course, the temperature sensor 66 may be disposed on the solenoid 62, and may directly measure the temperature of the solenoid 62. Furthermore, the temperature sensor 66 does not necessarily need to be disposed in the switching unit 60. It is only necessary to dispose the temperature sensor 66 in the image forming apparatus 1. In other words, because there is a correlation between the temperature value measured by the temperature sensor 66 and the temperature of the solenoid 62, the temperature of the solenoid 62 can be determined using the measured temperature value of the temperature sensor 66.

FIGS. 8A to 8D are graphs for explaining the control signal (the drive signal) that is output from the current controller 64 in the present exemplary embodiment.

Figure 8A:
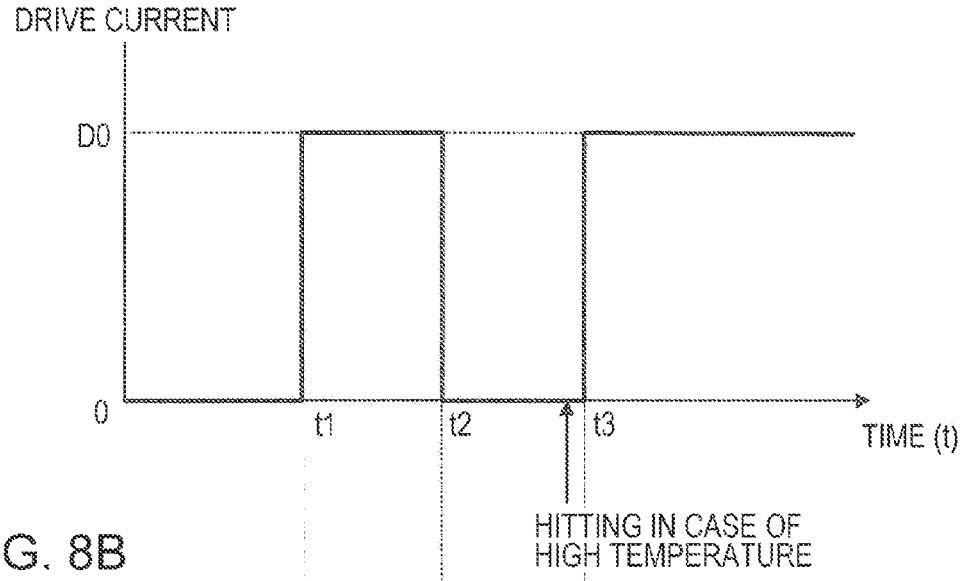
FIGS. 8A to 8D are graphs for explaining a control signal (a drive signal) that is output from a current controller in the present exemplary embodiment.
Figure 8B:
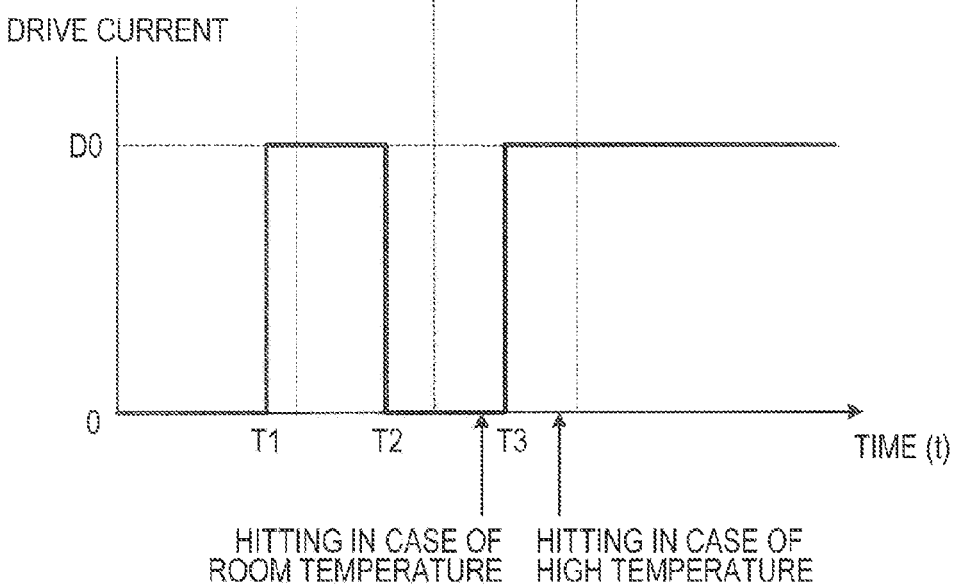

Among FIGS. 8A to 8D, FIG. 8A is a graph for explaining the control signal (the drive signal) that is output from the current controller 64 in the case of moving the gate member 61 from the first position to the second position. Here, the vertical axis represents the amount of drive current, and the horizontal axis represents time (t). Furthermore, FIG. 8B is the same as FIG. 5A, and is provided for comparison. Note that, in FIGS. 8A and 8B, a time at which the gate member 61 hits the stopper 612 when the temperature of the solenoid 62 is a normal temperature (a room temperature) is illustrated as "hitting in case of room temperature", and a time at which the gate member 61 hits the stopper 612 when the temperature of the solenoid 62 is a high temperature is illustrated as "hitting in case of high temperature".

When the drive controller 67 determines that the position of the gate member 61 needs to be switched, the drive controller 67 performs control so as to output the ON signal at a time t1, to output the OFF signal at a time t2, and to output the ON signal a time t3 again. In accordance with the ON signal or the OFF signal, as illustrated in FIG. 8A, the current controller 64 outputs the drive signal having the amount D0 of drive current for a time period from the time t1 to the time t2 and at the time t3 and thereafter.

As is clear from comparison between FIGS. 8A and 8B, referring to FIG. 8A, the time t1 is later than the time T1, compared with FIG. 8B. Furthermore, the time t2 is later than the time T2, and the time t3 is later than the time T3 (which are represented by relationships t1>T1, t2>T2, and t3>T3).

Figure 8C:
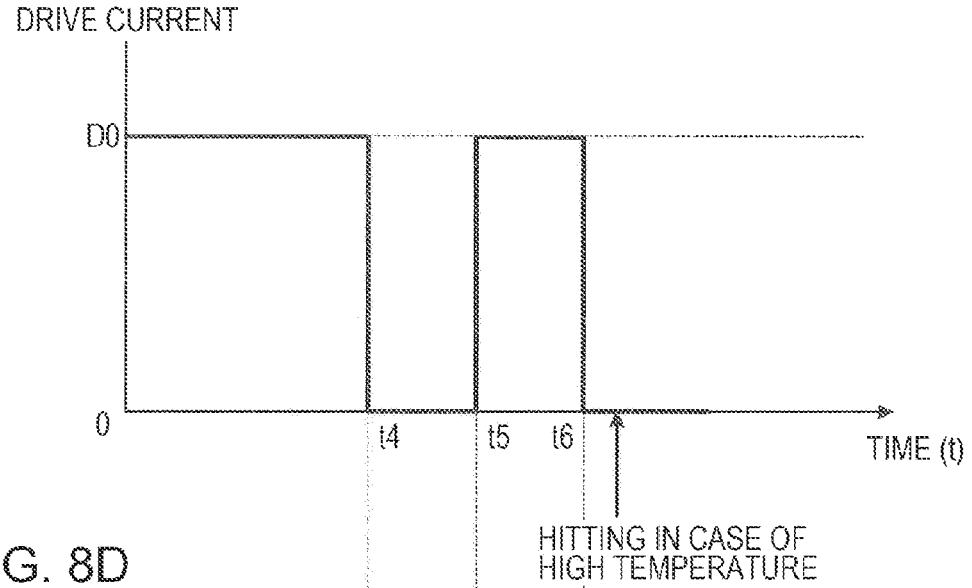
Figure 8D:
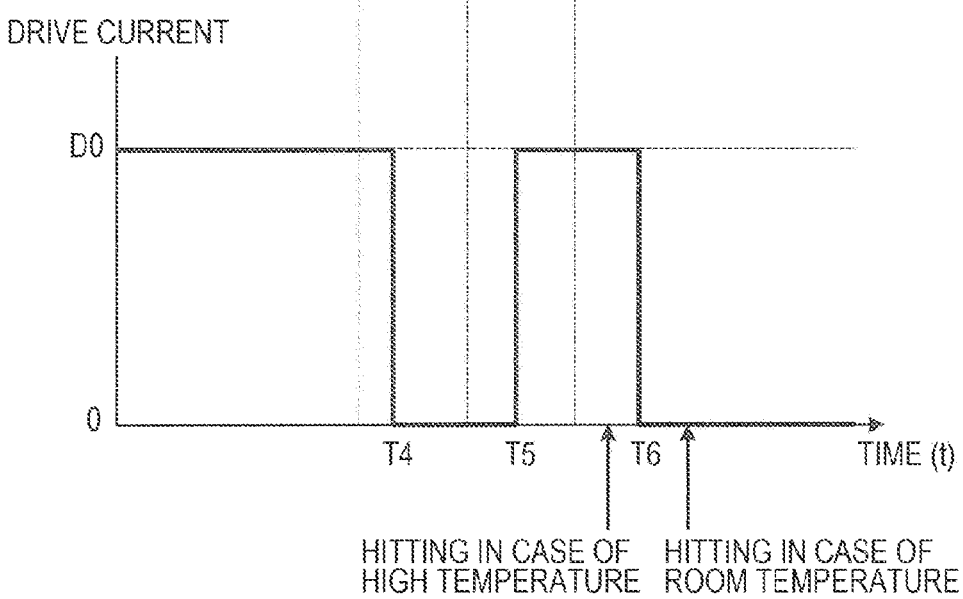

In contrast, FIG. 8C is a graph for explaining the control signal (the drive signal) that is output from the current controller 64 in the case of moving the gate member 61 from the second position to the first position when the temperature of the solenoid 62 increases. Here, the vertical axis represents the amount of drive current, and the horizontal axis represents time (t). Furthermore, FIG. 8D is the same as FIG. 5C, and is provided for comparison. Note that, in FIGS. 8C and 8D, a time at which the gate member 61 hits the stopper 611 when the temperature of the solenoid 62 is a normal temperature (a room temperature) is illustrated as "hitting in case of room temperature", and a time at which the gate member 61 hits the stopper 611 when the temperature of the solenoid 62 is a high temperature is illustrated as "hitting in case of high temperature".

As illustrated in FIG. 8C, when the drive controller 67 determines that the position of the gate member 61 needs to be switched, the drive controller 67 performs control so as to output the OFF signal at a time t4, to output the ON signal at a time t5, and to output the OFF signal a time t6 again. In accordance with the ON signal or the OFF signal, as illustrated in FIG. 8C, the current controller 64 outputs the drive signal having the amount D0 of drive current at the time t4 and prior thereto and a time period from the time t5 to the time t6.

As is clear from comparison between FIGS. 8C and 8D, referring to FIG. 8C, the time t4 is earlier than the time T4, compared with FIG. 8D. Furthermore, the time t5 is earlier than the time T5, and the time t6 is earlier than the time T6 (which are represented by relationships t4<T4, t5<T5, and t6<T6).

As described above, in the present exemplary embodiment, when the temperature of the solenoid 62 increases and, consequently, the switching time period in the case of moving the position of the gate member 61 from the first position to the second position increases, a time at which the control signal, i.e., the ON signal or the OFF signal, is output is changed in accordance with the increase in the switching time period. More specifically, when the temperature of the solenoid 62 increases, the time at which the ON signal or the OFF signal is output is changed so as to be later than the time was prior to being changed. Accordingly, even when the temperature of the solenoid 62 varies, the operation of the gate member 61 does not easily change. Thus, the volume of the sound of the gate member 61 hitting the stopper 612 in the case of switching the position of the gate member 61 can be reduced. In contrast, when the temperature of the solenoid 62 increases and, consequently, the switching time period in the case of moving the position of the gate member 61 from the second position to the first position decreases, conversely, the time at which the ON signal or the OFF signal is output is changed so as to be earlier than the time was prior to being changed.

In reality, when the temperature of the solenoid 62 is a normal temperature (a room temperature), control patterns illustrated in FIGS. 8B and 8D are used as control patterns. When the temperature of the solenoid 62 becomes a temperature (a high temperature) exceeding a predetermined threshold, the control patterns are changed to control patterns illustrated in FIGS. 8A and 8C. Note that the control patterns are not limited thereto. For example, multiple thresholds may be provided, and, in each case in which the temperature of the solenoid 62 exceeds a corresponding one of the thresholds, a control pattern that is predetermined for the case may be used. Moreover, a method may be used, in which the determination unit 673 calculates, using a predetermined calculation formula, the times t1 to t6 on the basis of the temperature information obtained from the temperature sensor 66.

Note that, regarding the above-described change of the control patterns, in other words, in a case of moving the gate member 61 between the first position and the second position by increasing the force exerted on the gate member 61, the time at which the force is increased or reduced is changed in accordance with an increase in the temperature of the solenoid 62 so that the time is later than the time was prior to being changed. In a case of moving the gate member 61 between the first position and the second position by reducing the force exerted on the gate member 61, the time at which the force is increased or reduced is changed in accordance with an increase in the temperature of the solenoid 62 so that the time is earlier than the time was prior to being changed.

Next, a method for controlling the gate member 61 in the present exemplary embodiment will be described.

Figure 9:
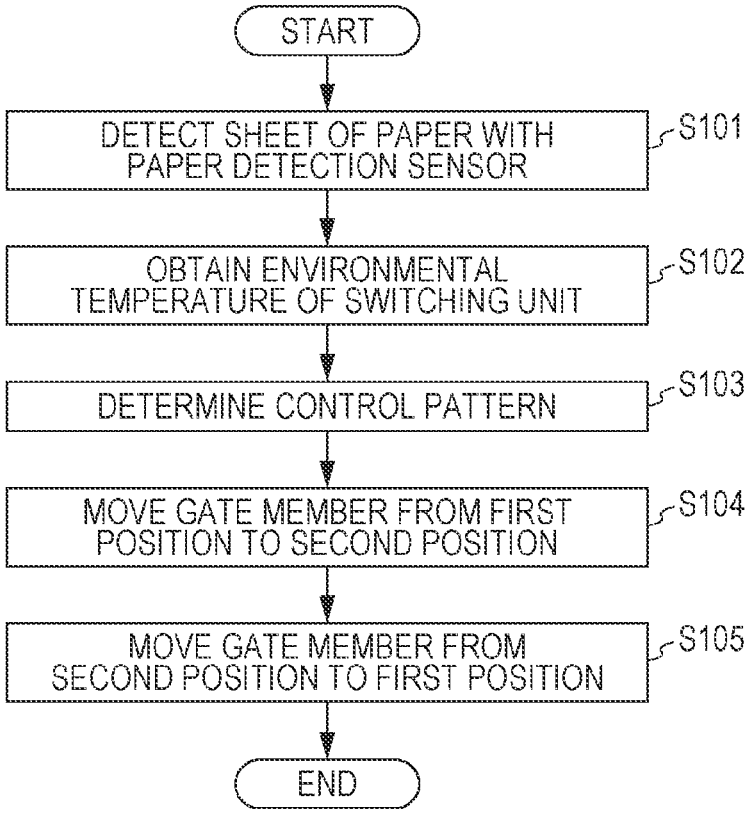
FIG. 9 is a flowchart for explaining a method for controlling the gate member in the present exemplary embodiment.

FIG. 9 is a flowchart for explaining the method for controlling the gate member 61 in the present exemplary embodiment.

In the case of moving the gate member 61 from the first position to the second position, first, the paper detection sensor 65 detects a sheet of paper P to obtain the detection signal, and transmits the detection signal to the detection-signal obtaining unit 671 of the drive controller 67 (step S101). The drive controller 67, which has received the detection signal from the paper detection sensor 65, causes the temperature obtaining unit 672 to obtain the environmental temperature of the switching unit 60 from the temperature sensor 66 (step S102). Then, the drive controller 67 causes the determination unit 673 to determine times at which the control signal is output so as to be suitable for the environmental temperature (step S103). In this case, the determination unit 673 determines the times with reference to the data and so forth stored in the memory 674. Then, at the determined times, the drive controller 67 outputs the control signal, i.e., the ON signal or the OFF signal, from the output unit 675, for example, using the control pattern illustrated in FIG. 8A (step S104). Accordingly, the gate member 61 is moved from the first position to the second position.

Furthermore, in the case of returning the gate member 61 from the second position to the first position, at the determined times, the drive controller 67 outputs the control signal, i.e., the ON signal or the OFF signal, from the output unit 675, for example, using the control pattern illustrated in FIG. 8C (step S105). Accordingly, the gate member 61 is retuned from the second position to the first position.

Note that the control pattern of the control signal that is output from the output unit 675 in the present exemplary embodiment is not limited to any one of the control patterns illustrated in FIGS. 5A, 5C, and 8A to 8D.

FIGS. 10A to 10D are graphs illustrating other control patterns of the control signal that is output from the current controller 64.

Figure 10A:
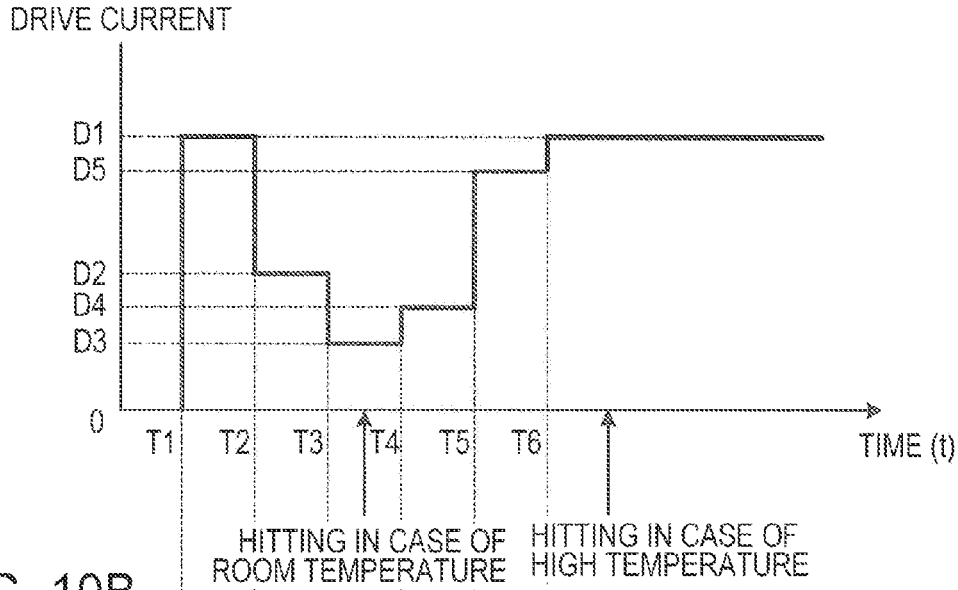
FIGS. 10A to 10D are graphs illustrating other control patterns of the control signal that is output from the current controller.
Figure 10B:
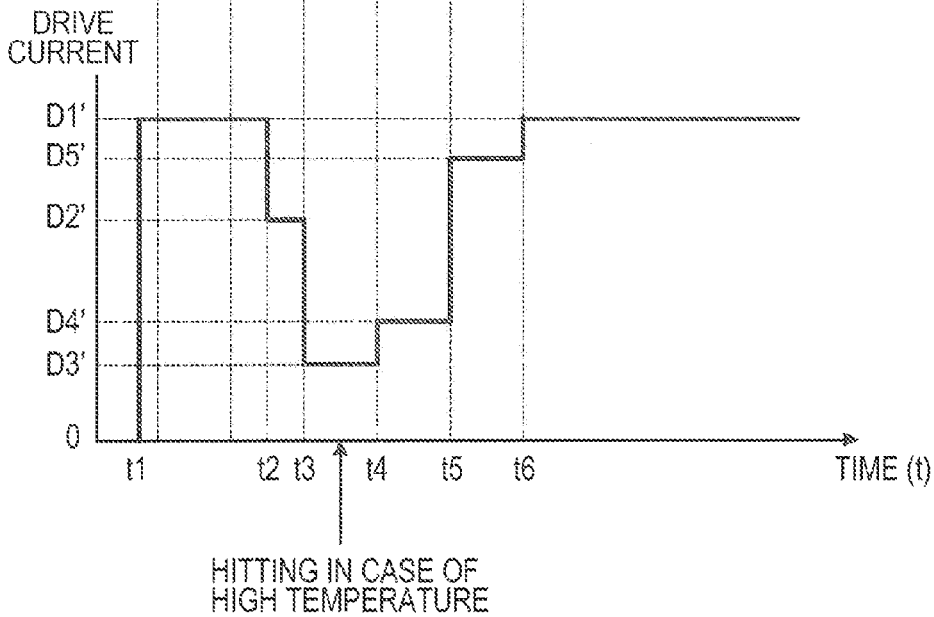
Figure 10C:
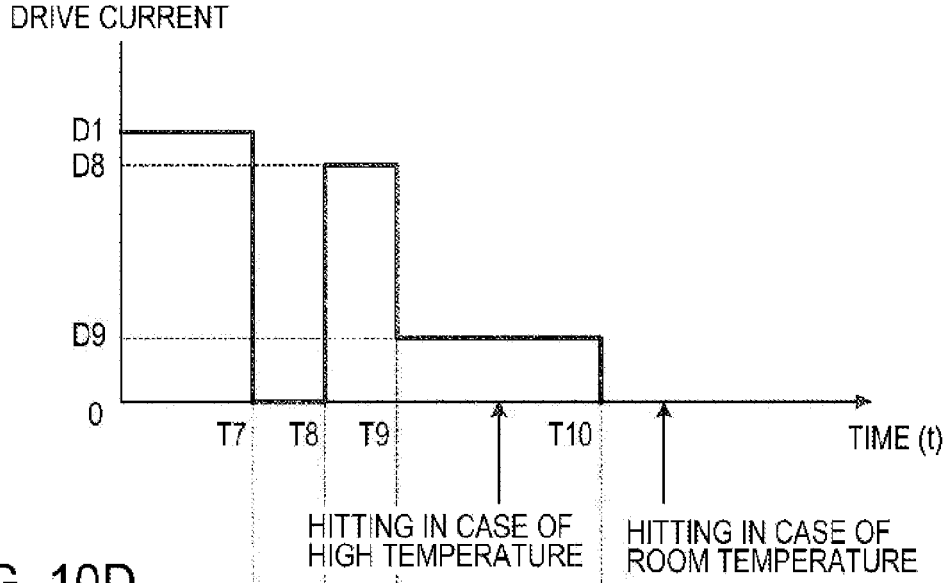
Figure 10D:
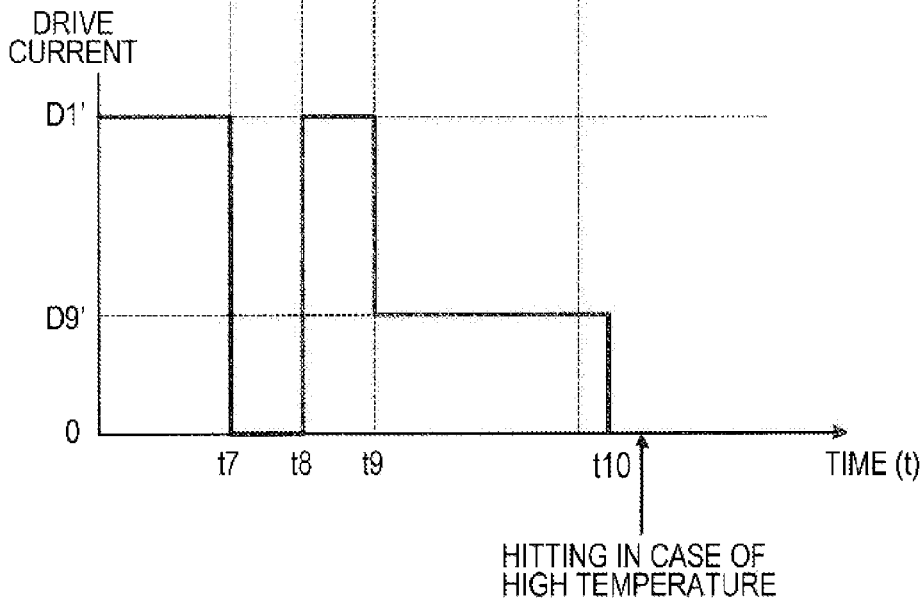

Here, regarding the control patterns illustrated in FIGS. 10A and 10B, FIGS. 10A and 10B are graphs for explaining the drive current that is output from the current controller 64 in the case of moving the gate member 61 from the first position to the second position. Furthermore, regarding the control patterns illustrated in FIGS. 10C and 10D, FIGS. 10C and 10D are graphs for explaining the drive current that is output from the current controller 64, conversely, in the case of moving the gate member 61 from the second position to the first position. Also regarding the graphs, the vertical axis represents the amount of drive current, and the horizontal axis represents time (t). Note that, in FIGS. 10A to 10D, a time at which the gate member 61 hits the stopper 611 or 612 when the temperature of the solenoid 62 is a normal temperature (a room temperature) is illustrated as "hitting in case of room temperature", and a time at which the gate member 61 hits the stopper 611 or 612 when the temperature of the solenoid 62 is a high temperature is illustrated as "hitting in case of high temperature".

Here, FIG. 10A illustrates a control pattern used when the temperature of the solenoid 62 is a room temperature, and FIG. 10B illustrates a control pattern used when the temperature of the solenoid 62 is a high temperature.

As illustrated in FIG. 10A, when the temperature of the solenoid 62 is a room temperature, in the case of moving the gate member 61 from the first position to the second position, first, the current controller 64 outputs a drive signal having an amount D1 of drive current at a time T1. Then, at a time T2, the current controller 64 performs control of reducing the amount of drive current to an amount D2 that is smaller than the amount D1. Furthermore, at a time T3, the current controller 64 performs control of successively reducing the amount of drive current to an amount D3. Then, after the gate member 61 is in contact with the stopper 612 and is moved to the second position, next, conversely, the current controller 64 performs control of increasing the amount of drive current from the amount D3 to an amount D4, from the amount D4 to an amount D5, and from the amount D5 to the amount D1 at times T4, T5, and T6, respectively.

As described above, in the present exemplary embodiment, the force exerted on the gate member 61 is increased or reduced before and after the gate member 61 is in contact with the stopper 611 or 612.

In other words, in the control pattern illustrated in FIG. 10A, before the gate member 61 hits the stopper 612, the amount of drive current is reduced in a step-by-step manner. In this manner, the switching speed of the gate member 61 can be gradually reduced. Accordingly, even when the time at which the gate member 61 hits the stopper 612 slightly shifts from an estimated time, an increase in the volume of the hitting sound does not easily occur.

Furthermore, in the control pattern, after the gate member 61 has hit the stopper 612, the amount of drive current is increased in a step-by-step manner. The reason for this is that, in a case in which the gate member 61 bounces back after the gate member 61 has hit the stopper 612, when the amount of drive current has suddenly been retuned to the amount D1, the gate member 61 is pulled back to the stopper 612 at a higher speed by a strong driving force that is generated in the solenoid 62 by the large amount of drive current, resulting in a loud sound of the gate member 61 hitting the stopper 612 at a high speed. In other words, even in a case in which the gate member 61 bounces back after the gate member 61 has hit the stopper 612, if the gate member 61 is pulled back using a small amount of drive current, the gate member 61 hits the stopper 612 at a lower speed. Accordingly, a loud hitting sound does not easily occur.

In contrast, as illustrated in FIG. 10B, when the temperature of the solenoid 62 is a high temperature, in the case of moving the gate member 61 from the first position to the second position, first, the current controller 64 outputs a drive signal having an amount D1' of drive current at a time t1. The amount D1' of drive current is larger than the amount D1 (which is represented by a relationship D1'>D1). Furthermore, the time t1 is earlier than the time T1 (which is represented by a relationship t1<T1). The current controller 64 performs control of reducing the amount of drive current to an amount D2' at a time t2. The time t2 is later than the time T2 (which is represented by a relationship t2>T2). Then, the current controller 64 performs control of successively reducing the amount of drive current to an amount D3' at a time t3. Moreover, after the gate member 61 is in contact with the stopper 612 and is moved to the second position, next, conversely, the current controller 64 performs control of increasing the amount of drive current from the amount D3' to an amount D4', from the amount D4' to an amount D5', and from the amount D5' to the amount D1' at times t4, t5, and t6, respectively. Relationships D3'>D3, D4'>D4, and D5'>D5 are satisfied for the amount of drive current in this case. However, the times t3, t4, t5, and t6 may be the same as the times T3, T4, T5, and T6, respectively (which are represented by equations t3=T3, t4=T4, t5=T5, and t6=T6).

In other words, in the control pattern, when the temperature of the solenoid 62 is a high temperature, at the early stage in the case of moving the gate member 61 from the first position to the second position, the solenoid 62 is driven using a larger drive current for a longer time period, compared with those used when the temperature of the solenoid 62 is a room temperature. Accordingly, at the early stage in the case of moving the gate member 61, the gate member 61 can be moved at a speed substantially the same as the speed at which the gate member 61 is moved when the temperature of the solenoid 62 is a room temperature. Additionally, at the time t2 and thereafter, by increasing the amount of drive current so that the amount of drive current is larger than the amount of drive current used when the temperature of the solenoid 62 is a room temperature, the gate member 61 can also be moved at a speed substantially the same as the speed at which the gate member 61 is moved when the temperature of the solenoid 62 is a room temperature. Accordingly, in the control pattern, the time at which the gate member 61 hits the stopper 612 is substantially the same as the time at which the gate member 61 hits the stopper 612 when the temperature of the solenoid 62 is a room temperature. In other words, in this case, both when the temperature of the solenoid 62 is a room temperature and when the temperature of the solenoid 62 is a high temperature, the gate member 61 hits the stopper 612 at substantially the same speed at substantially the same time. Thus, when the temperature of the solenoid 62 is a high temperature, an increase in the volume of the hitting sound also does not easily occur.

Note that, in the case of moving the gate member 61 using the control pattern illustrated in FIG. 10A when the temperature of the solenoid 62 is a high temperature, the time at which the gate member 61 hits the stopper 612 becomes later than the time at which the gate member 61 hits the stopper 612 when the temperature of the solenoid 62 is a room temperature. For example, as illustrated in FIG. 10A, the gate member 61 hits the stopper 612 after the time T6. In this case, the gate member 61 hits the stopper 612 after the amount of drive current has been increased from the amount D3 to the amount D4, from the amount D4 to the amount D5, and from the amount D5 to the amount D1. Accordingly, the speed of the gate member 61 accelerates at the time T4 and thereafter. Thus, the gate member 61 hits the stopper 612 at a higher speed. Therefore, a loud hitting sound occurs.

Next, the case of moving the gate member 61 from the second position to the first position will be described.

FIG. 10C illustrates a control pattern used when the temperature of the solenoid 62 is a room temperature, and FIG. 10D illustrates a control pattern used when the temperature of the solenoid 62 is a high temperature.

As illustrated in FIG. 10C, when the temperature of the solenoid 62 is a room temperature, in the case of moving the gate member 61 from the second position to the first position, first, the current controller 64 outputs a drive signal having an amount 0 of drive current, which is represented by 0%, at a time T7. Then, the current controller 64 performs control of increasing the amount of drive current to an amount D8 at a time T8. Furthermore, the current controller 64 performs control of reducing the amount of drive current to an amount D9 at a time T9. Moreover, the current controller 64 outputs the drive signal having the amount 0 of drive current at a time T10 and thereafter.

The switching speed of the gate member 61 can be gradually reduced using the control pattern. As in the case described with reference to FIG. 10A, even when the time at which the gate member 61 is in contact with the stopper 611 slightly shifts from an estimated time, an increase in the volume of the hitting sound does not easily occur. Furthermore, even when even the gate member 61 bounces back after the gate member 61 is in contact with the stopper 611, a loud hitting sound does not easily occur.

In contrast, as illustrated in FIG. 10D, when the temperature of the solenoid 62 is a high temperature, in the case of moving the gate member 61 from the second position to the first position, the current controller 64 outputs the drive signal having the amount 0 of drive current, which is represented by 0%, at a time t7. Then, the current controller 64 performs control of increasing the amount of drive current to the amount D1' at a time t8. Furthermore, the current controller 64 performs control of reducing the amount of drive current to an amount D9' at a time t9. Moreover, the current controller 64 outputs the drive signal having the amount 0 of drive current at a time t10 and thereafter. In this case, a relationship D9'>D9 is satisfied for the drive current. Additionally, regarding the times, although equations t7=T7, t8=T8, and t9=T9 may be satisfied, a relationship t10>T10 is satisfied.

In other words, in the control pattern, when the temperature of the solenoid 62 is a high temperature, in a time period from the time t8 to the time t9, the solenoid 62 is driven using a drive current that is larger than the drive current used when the temperature of the solenoid 62 is a room temperature. Accordingly, before the time t9, the gate member 61 can be moved at a speed substantially the same as the speed at which the gate member 61 is moved when the temperature of the solenoid 62 is a room temperature. Additionally, at the time t9 and thereafter, by increasing the amount of drive current and a drive time period for which the solenoid 62 is being driven, the gate member 61 can also be moved at a speed substantially the same as the speed at which the gate member 61 is moved when the temperature of the solenoid 62 is a room temperature. Accordingly, in the control pattern, the time at which the gate member 61 hits the stopper 611 is substantially the same as the time at which the gate member 61 hits the stopper 611 when the temperature of the solenoid 62 is a room temperature. Thus, both when the temperature of the solenoid 62 is a room temperature and when the temperature of the solenoid 62 is a high temperature, the gate member 61 hits the stopper 611 at substantially the same speed at substantially the same time. Therefore, when the temperature of the solenoid 62 is a high temperature, an increase in the volume of the hitting sound also does not easily occur.

Note that, in the case of moving the gate member 61 using the control pattern illustrated in FIG. 10C when the temperature of the solenoid 62 is a high temperature, the time at which the gate member 61 hits the stopper 611 becomes earlier than the time at which the gate member 61 hits the stopper 611 when the temperature of the solenoid 62 is a room temperature. For example, as illustrated in FIG. 10C, the gate member 61 hits the stopper 611 before the time T10. In this case, a reduction in the speed of the gate member 61 is not sufficient. Accordingly, the gate member 61 hits the stopper 611 at a higher speed. Thus, a loud hitting sound occurs.

Note that, in the above-described example, the environmental temperature of the switching unit 60 is measured by the temperature sensor 66 disposed in the switching unit 60, and the temperature of the solenoid 62 is estimated using the environmental temperature. However, the present invention is not to the above-described example.

Figure 11:
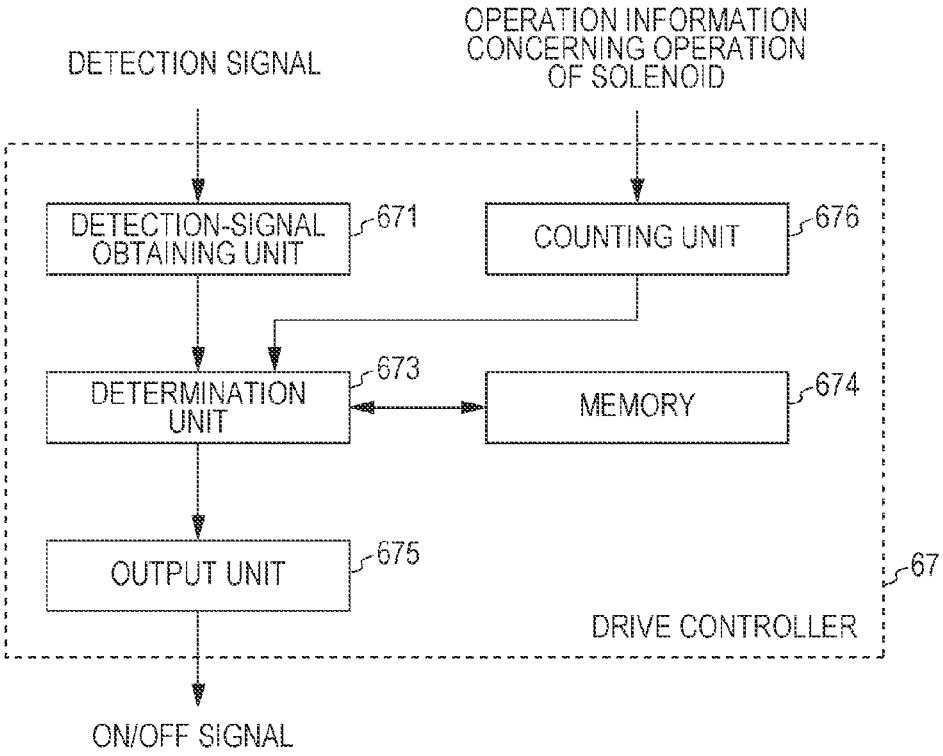
FIG. 11 is a block diagram illustrating another example of the drive controller in the present exemplary embodiment.

FIG. 11 is a block diagram illustrating another example of the drive controller 67 in the present exemplary embodiment.

Compared with the drive controller 67 illustrated in FIG. 7, a drive controller 67 illustrated in FIG. 11 includes a counting unit 676 that counts the number of times the solenoid 62 operates instead of the temperature obtaining unit 672 that obtains temperature information from the temperature sensor 66.

In the drive controller 67, the determination unit 673 determines, on the basis of the detection signal obtained by the detection-signal obtaining unit 671 and operation information that concerns the operation of the solenoid 62 and that is obtained by the counting unit 676, times at which the control signal is output. In other words, there is a correlation between the latest number of times the solenoid 62 operates, which has been counted by the counting unit 676, and the temperature of the solenoid 62. The temperature of the solenoid 62 increases with increasing number of times the solenoid 62 operates. In a present exemplary embodiment, the determination unit 673 calculates the number of times the solenoid 62 operates in a predetermined time period, and determines, on the basis of the calculated number of times, times at which the control signal is output. Note that the temperature information concerning the temperature of the solenoid 62 is not used in the exemplary embodiment. However, as mentioned above, there is a correlation between the number of times the solenoid 62 operates per unit time and the temperature of the solenoid 62. Accordingly, in other words, the drive controller 67 changes, on the basis of the temperature of the solenoid 62, the times at which the force exerted on the gate member 61 is increased or reduced.

Figure 12:
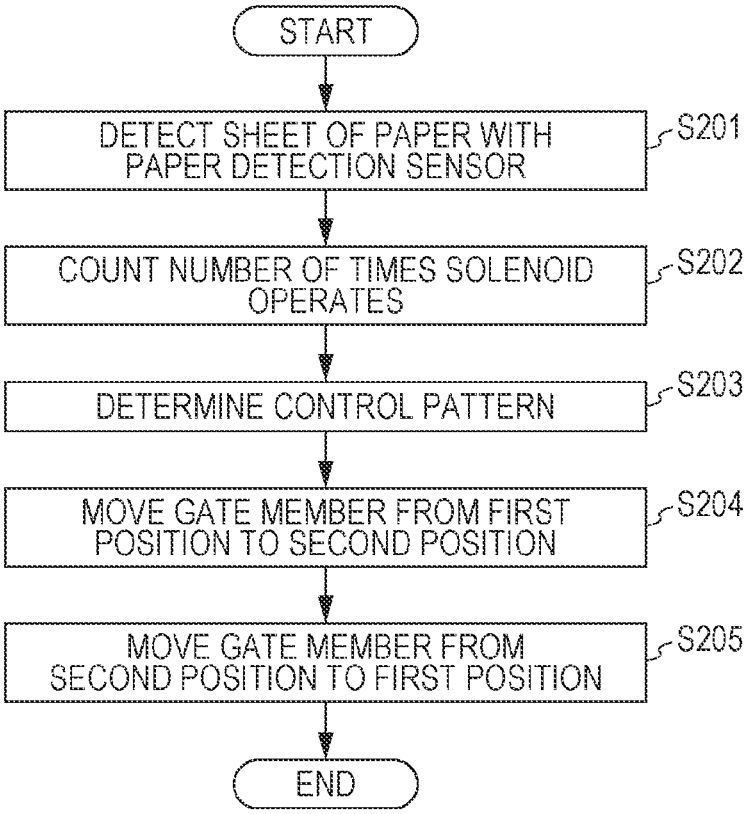
FIG. 12 is a flowchart for explaining a method for controlling the gate member in a case in which the drive controller illustrated in FIG. 11 is used.

FIG. 12 is a flowchart for explaining a method for controlling the gate member 61 in a case in which the drive controller 67 illustrated in FIG. 11 is used.

In the case of moving the gate member 61 from the first position to the second position, first, the paper detection sensor 65 detects a sheet of paper P to obtain the detection signal, and transmits the detection signal to the detection-signal obtaining unit 671 of the drive controller 67 (step S201). The drive controller 67, which has received the detection signal from the paper detection sensor 65, causes the counting unit 676 to, using the operation information concerning the operation of solenoid 62, count the number of times the solenoid 62 operates (step S202). Then, the drive controller 67 causes the determination unit 673 to calculate the number of times the solenoid 62 operates in the predetermined time period, and to determine, on the basis of the calculated number of times, times at which the control signal is output (step S203). In this case, the determination unit 673 determines the times with reference to the data and so forth stored in the memory 674. Then, at the determined times, the drive controller 67 outputs the control signal from the output unit 675 using a predetermined control pattern (step S204). Accordingly, the gate member 61 is moved from the first position to the second position.

Furthermore, in the case of returning the gate member 61 from the second position to the first position, at the times determined by the determination unit 673, the drive controller 67 outputs the control signal from the output unit 675 using a predetermined control pattern (step S205). Accordingly, the gate member 61 is retuned from the second position to the first position.

Note that, in the present exemplary embodiment, the switching unit 60 that is disposed downstream of the fixing unit 30 in the image forming apparatus 1 is described. However, as a matter of course, the present invention may be applied to another switching device that switches the transport direction of a sheet of paper P.

Description of Program

The above-described process performed by the drive controller 67 or the current controller 64 is realized by collaboration between a software resource and a hardware resource. In other words, a CPU that is built in a control computer provided in the drive controller 67 or the current controller 64 and that is not illustrated executes a program for realizing the individual functions of the drive controller 67 or the current controller 64, thereby realizing the individual functions.

Accordingly, the process performed by the drive controller 67 or the current controller 64 may also be considered as a program for realizing the following functions: a function of controlling the solenoid 62 that moves the gate member 61 between the first position and the second position by increasing or reducing, at predetermined times, the force exerted on the gate member 61 which switches the transport direction of a sheet of paper P by being selectively moved to the first position or the second position in a mechanism unit of the image forming apparatus 1 that forms an image on the sheet of paper P; a function of determining the temperature of the solenoid 62; and a function of changing, on the basis of the temperature of the solenoid 62, the times at which the force exerted on the gate member 61 is increased or reduced.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A device for switching a transport direction of a recording material, the device comprising:

a switching unit that switches a transport direction of a recording material by being selectively moved to a first position or a second position; and a movement unit that moves the switching unit between the first position and the second position by increasing or reducing a force exerted on the switching unit, wherein the movement unit changes, on the basis of a temperature of the movement unit, timing at which the force exerted on the switching unit is increased or reduced, wherein, in a case of moving the switching unit between the first position and the second position by increasing the force exerted on the switching unit, the movement unit changes the timing in accordance with an increase in the temperature of the movement unit so that the timing is later than the timing that was prior to being changed, and, in a case of moving the switching unit between the second position and the first position by reducing the force exerted on the switching unit, the movement unit changes the timing in accordance with an increase in the temperature of the movement unit so that the timing is earlier than the timing that was prior to being changed.

2. The device for switching a transport direction of a recording material according to claim 1, further comprising a defining unit that defines the first position and the second position by being in contact with the switching unit, wherein, before and after the switching unit is in contact with the defining unit, the movement unit increases or reduces the force exerted on the switching unit.

3. The device for switching a transport direction of a recording material according to claim 1, further comprising a defining unit that defines the first position and the second position by being in contact with the switching unit, wherein, before and after the switching unit is in contact with the defining unit, the movement unit increases or reduces the force exerted on the switching unit.

4. An image forming apparatus comprising:

a toner-image forming unit that forms a toner image;

a recording-material transport unit that transports a recording material;

a transfer unit that transfers the toner image, which has been formed by the toner-image forming unit, onto the recording material, which is transported by the recording-material transport unit;

a fixing unit that fixes the toner image, which has been transferred onto the recording material by the transfer unit;

a switching unit that switches a transport direction of the recording material by being selectively moved to a first position or a second position;

a movement unit that moves the switching unit between the first position and the second position by increasing or reducing a force exerted on the switching unit; and a controller that controls the movement unit, wherein the controller changes, on the basis of a temperature of the movement unit, timing at which the force exerted on the switching unit is increased or reduced, wherein, in a case of moving the switching unit between the first position and the second position by increasing the force exerted on the switching unit, the movement unit changes the timing in accordance with an increase in the temperature of the movement unit so that the timing is later than the timing that was prior to being changed, and, in a case of moving the switching unit between the second position and the first position by reducing the force exerted on the switching unit, the movement unit changes the timing in accordance with an increase in the temperature of the movement unit so that the timing is earlier than the timing that was prior to being changed.

5. The image forming apparatus according to claim 4, further comprising a defining unit that defines the first position and the second position by being in contact with the switching unit, wherein, before and after the switching unit is in contact with the defining unit, the movement unit increases or reduces the force exerted on the switching unit.

* * * * *